US012188743B2

(12) United States Patent
Kronengold et al.

(10) Patent No.: US 12,188,743 B2
(45) **Date of Patent: *Jan. 7, 2025**

(54) MODULAR STOCK FOR A LONG GUN

(71) Applicant: Savage Arms, Inc., Westfield, MA (US)

(72) Inventors: David Kronengold, Barkhamsted, CT (US); Michael J. Withey, Belchertown, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/106,940

(22) Filed: Feb. 7, 2023

(65) Prior Publication Data

US 2023/0375306 A1 Nov. 23, 2023

Related U.S. Application Data

(63) Continuation of application No. 16/990,395, filed on Aug. 11, 2020, now Pat. No. 11,573,065, which is a (Continued)

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/08; F41C 23/20
See application file for complete search history.

(56) References Cited

U.S. PATENT DOCUMENTS 4,055,016 A 10/1977 Katsenes
4,203,244 A 5/1980 Hickman
(Continued)

FOREIGN PATENT DOCUMENTS

EP 1396697 A2 3/2004
EP 0982558 B1 9/2005
(Continued)

OTHER PUBLICATIONS

"Ruger American Rimfire Modular Stock System", downloaded from the internet at http://www.ruger.com/products/americanRimfire/index.html, last visited on Mar. 16, 2014.
(Continued)

*Primary Examiner* — Rick K Chang
(74) *Attorney, Agent, or Firm* — Christensen, Fonder, Dardi & Herbert PLLC; Douglas J. Christensen; Timothy J. Busse

(57) ABSTRACT

A modular system for adjusting the length of pull and drop of a long gun. The modular system enables a combination of any one of a plurality of comb portions with any one or more of a plurality of butt pad components for a versatile and robust system that provides a wide range of comb height and length of pull combinations. The system can be implemented by the user, avoiding costly gun fitters. The system provides these aspects in a sleek, streamlined way that does not mar the appearance of the long gun. The spacers for the length of pull adjustment include registration surfaces that provide a three-dimensional interface with the buttstock and comb portion for enhanced strength and stability of the assembly over that of conventional fit adjustment systems.

17 Claims, 19 Drawing Sheets

Related U.S. Application Data continuation of application No. 15/952,664, filed on Apr. 13, 2018, now Pat. No. 10,739,106.

(56) References Cited

U.S. PATENT DOCUMENTS

| | | | |
|---|---|---|---|
| 4,896,446 | A | 1/1990 | Gregory |
| 4,976,038 | A | 12/1990 | Nattrass |
| 5,001,855 | A | 3/1991 | Griggs |
| 5,149,899 | A | 9/1992 | Dabrowski |
| 5,392,553 | A | 2/1995 | Carey |
| 5,711,102 | A | 1/1998 | Plaster et al. |
| 5,970,642 | A | 10/1999 | Martin |
| 6,374,528 | B1 | 4/2002 | Davis et al. |
| 6,594,935 | B2 | 7/2003 | Beretta |
| 7,104,002 | B2 | 9/2006 | Rotundo |
| 7,536,819 | B2 | 5/2009 | Popikow |
| 7,631,453 | B2 | 12/2009 | Longueira |
| 7,665,240 | B1 | 2/2010 | Bentley |
| 7,793,453 | B1 | 9/2010 | Sewell, Jr. et al. |
| 7,802,392 | B2 | 9/2010 | Peterson et al. |
| 7,805,873 | B2 | 10/2010 | Bentley |
| D626,618 | S | 11/2010 | Peterson et al. |
| 7,926,217 | B2 | 4/2011 | McCann |
| 7,966,760 | B2 | 6/2011 | Fitzpatrick et al. |
| 7,984,580 | B1 | 7/2011 | Giauque et al. |
| 8,393,107 | B2 | 3/2013 | Brown |
| 8,844,185 | B2 | 9/2014 | Jarboe |
| D717,386 | S | 11/2014 | Moretti |
| 8,904,692 | B2 | 12/2014 | Ballard |
| D730,478 | S | 5/2015 | Sims |
| D733,247 | S | 6/2015 | Lewis et al. |
| 9,074,839 | B2 | 7/2015 | Warburton |
| D742,470 | S | 11/2015 | Battaglia |
| 9,417,033 | B2 | 8/2016 | Wood et al. |
| D823,979 | S | 7/2018 | Stevens |
| D823,980 | S | 7/2018 | Stevens |
| 10,113,831 | B2 | 10/2018 | Moretti |
| D844,736 | S | 4/2019 | Tipton |
| 10,302,387 | B2 | 5/2019 | Doty et al. |
| D889,582 | S | 7/2020 | Kronengold et al. |
| 10,739,106 | B2 * | 8/2020 | Kronengold ..... F41C 23/20 |
| D905,191 | S | 12/2020 | Kronengold et al. |
| 11,573,065 | B2 | 2/2023 | Kronengold et al. |
| 2004/0211104 | A1 | 10/2004 | Eberle |
| 2010/0141428 | A1 | 6/2010 | Mildenberger et al. |
| 2010/0242333 | A1 * | 9/2010 | Kincel ..... F41C 23/14 42/73 |
| 2013/0025177 | A1 | 1/2013 | Bovensiep |
| 2014/0190055 | A1 | 7/2014 | Warburton |
| 2015/0338186 | A1 | 11/2015 | Hopkins |
| 2016/0010944 | A1 | 1/2016 | Downey et al. |
| 2016/0216060 | A1 | 7/2016 | Forslund |
| 2017/0254614 | A1 | 9/2017 | Moretti |
| 2019/0316873 | A1 | 10/2019 | Kronengold et al. |
| 2021/0108884 | A1 | 4/2021 | Kronengold et al. |

FOREIGN PATENT DOCUMENTS

| | | | |
|---|---|---|---|
| FR | 1170937 | A | 1/1959 |
| FR | 1500181 | A | 11/1967 |
| WO | WO2010141428 | A1 | 12/2010 |

OTHER PUBLICATIONS

Australian Examination Report for Application No. 2018204712 dated Apr. 2, 2019 (8 pages).

Wiley, S., "What is Length of Pull and why does it Matter?", Firearms, Jul. 10, 2013, available at http://blog.cheaperthandirt.com/length-pull-matter/, last visited Apr. 8, 2018.

youtube.com [online], "Benelli Simply Perfect," Benelli USA, visited Jul. 26, 2024, first available May 3, 2012, at URL <https://www.youtube.com/watch?v=BwfdZWQjD1I>, 1 pages.

* cited by examiner

MODULAR STOCK FOR A LONG GUN

CROSS-REFERENCE TO RELATED APPLICATION

This application is a continuation of U.S. patent application Ser. No. 16/990,395 filed Aug. 11, 2020, now U.S. Pat. No. 11,573,065, which claims priority to application Ser. No. 15/952,664, filed Apr. 13, 2018, now U.S. Pat. No. 10,739,106, the disclosures of which are incorporated by reference herein in their entirety.

FIELD OF THE DISCLOSURE

The present disclosure is directed generally to a stock for a long gun and more specifically to a modular stock for adjusting the comb height and length of pull of a long gun.

BACKGROUND OF THE DISCLOSURE

The fit of a long gun (shotgun or rifle) to a particular individual is characterized by the length of pull and the drop. The length of pull is the distance from the trigger to the end of the buttstock. The drop is the measurement between the line of sight and the comb of the buttstock. Most rifles and shotguns are designed for the average adult male. However, the physical fit characteristics of adult males vary significantly from the average adult male, as do the physical fit characteristics of women and youth. Therefore, many individuals find that many long guns do not feel comfortable or "fit" very well when shooting. The correct length of pull is when the sight picture is on target as the individual easily reaches the trigger, without straining the neck or shoulder to rest the cheek on the comb.

Several factors come into play when fitting a long gun, including the size of the individual, the length of the individual's neck, the thickness of the individual's cheek, and the hunting apparel that is the individual wears when the long gun is to be used. Another factor is whether a scope is used. The addition of a scope sometimes occurs after the firearm has been in use, such that a rifle that fit well without a scope does not fit well with the addition of a scope.

Fitting a long gun to a particular individual has created a need for specialists referred to as "gun fitters," which is different from a gun smith. However, the services of a gun fitter can be prohibitively expensive for the recreational hunter. See Wiley, S., "What is Length of Pull and why does it Matter?", *Firearms*, Jul. 10, 2013, available at http://blog.cheaperthandirt.com/length-pull-matter/, last visited Apr. 8, 2018, the disclosure of which is hereby incorporated by reference herein in its entirety except for express definitions contained therein.

Length of pull adjustment systems are commercially available. Buttstocks with a comb height adjustment system that alter the drop of the long gun also exist. However, there is a paucity of systems that integrate both aspects. A versatile and robust system that integrates length of pull and comb height adjustment would be welcomed.

SUMMARY OF THE DISCLOSURE

Various embodiments of the disclosure presents a modular system for fitting a long gun that enables a combination of any one of a plurality of comb portions with any one or more of a plurality of butt pad spacers for a versatile and robust system that provides a wide range of comb height and length of pull combinations. The system can be implemented by the user, avoiding costly gun fitters. The system provides these aspects in a sleek, streamlined way that does not mar the appearance of the long gun.

Furthermore, the spacers for the length of pull adjustment provides a three-dimensional interface with the buttstock and comb portion that enhances the strength and stability of the assembly over that of conventional fit adjustment systems. Though the individual comb portions and individual butt pad spacers are readily detachable and interchangeable, they are configured to mate with each other and with the buttstock portion in a rugged, durable connection that can withstand the rigors of field use and mitigates entry of debris and moisture into the buttstock.

As mentioned above, length of pull adjustment systems and comb height adjustment systems exist. However, many of these adjustment systems alter the stately, streamlined appearance of the long gun that many hunters and gun enthusiasts appreciate. One system that integrates both the length of pull and comb height adjustments is disclosed at U.S. Pat. No. 9,074,839 to Warburton ("Warburton"), the disclosure of which is incorporated by reference herein in its entirety except for patent claims and express definitions contained therein. However, the system disclosed by Warburton is of limited versatility, as it combines only certain comb heights with certain length of pull adjustments. The disclosed system remedies these shortcomings.

Structurally, various embodiments of the disclosure present a system for tailoring a comb height and a length of pull of a stock assembly for a long gun, comprising a buttstock portion and a kit. The kit includes a butt pad, a plurality of butt pad spacers, each configured for coupling with the butt pad, each of the plurality of butt pad spacers defining a respective spacing dimension between the butt pad and the buttstock portion, a plurality of comb portions, each of the comb portions configured for direct connection with any one of the plurality of butt pad spacers, each of the plurality of comb portions defining a respective comb height that differs from the others of the plurality of comb portions, and at least one fastener configured to pass through the butt pad and any one of the plurality of butt pad spacers to threadably engage the buttstock. Each of the plurality of butt pad spacers and each of the plurality of comb portions are configured for coupling with the buttstock portion. The butt pad, each of the plurality of butt pad spacers, and each of the plurality of comb portions are configured for securing to the buttstock portion with the at least one fastener.

In various embodiments of the disclosure, method is disclosed for adjusting a length of pull and a drop of a long gun, comprising: providing a buttstock portion, a plurality of comb portions, a plurality of butt pad spacers, and a butt pad; and providing assembly instructions on a tangible, non-transitory medium, the assembly instructions including: inserting a selected one of the plurality of comb portions into the buttstock portion so that a plurality of hook portions are inserted into a plurality of laterally inset slots defined between an upper portion and a lower portion of the buttstock portion; sliding the comb portion forward so that a bend portion of each of the plurality of hook portions engages a lower perimeter of a respective one of the plurality of laterally inset slots in a coupled position; registering a selected one of the plurality of butt pad spacers against a combined rearward registration surface the buttstock portion and the selected one of the plurality of comb portions; registering the butt pad against a rearward registration surface of the selected one of the plurality of butt pad spacers; inserting at least one fastener through the butt pad and the selected one of the plurality of butt pad spacers; and threading each of the at least one fastener into a corresponding tapping hole defined by the buttstock portion to secure the butt pad and the selected one of the plurality of butt pad spacers to the buttstock portion and to secure the selected one of the plurality of comb portions in the coupled position.

DETAILED DESCRIPTION OF THE FIGURES

Figure 1:
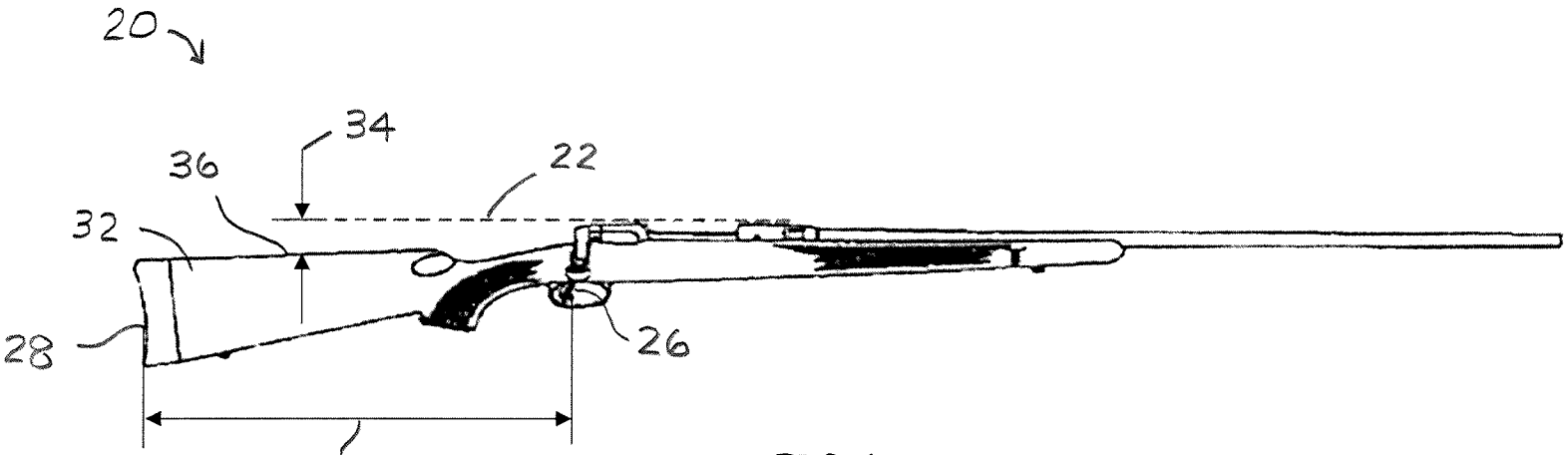
FIG. 1 Prior Art
FIG. 1 is a side elevational view of a conventional long gun, illustrating length of pull and drop parameters.

Referring to FIG. 1, a conventional long gun 20 is depicted having a line of sight 22. A length of pull 24 is illustrated, defined as the length from the trigger 26 to a butt end 28 of a buttstock 32 of the long gun 20 that is parallel to the line of sight 22. A drop 34 is also illustrated, defined as the distance between the line of sight 22 and a comb 36 of the buttstock 32.

Figure 2:
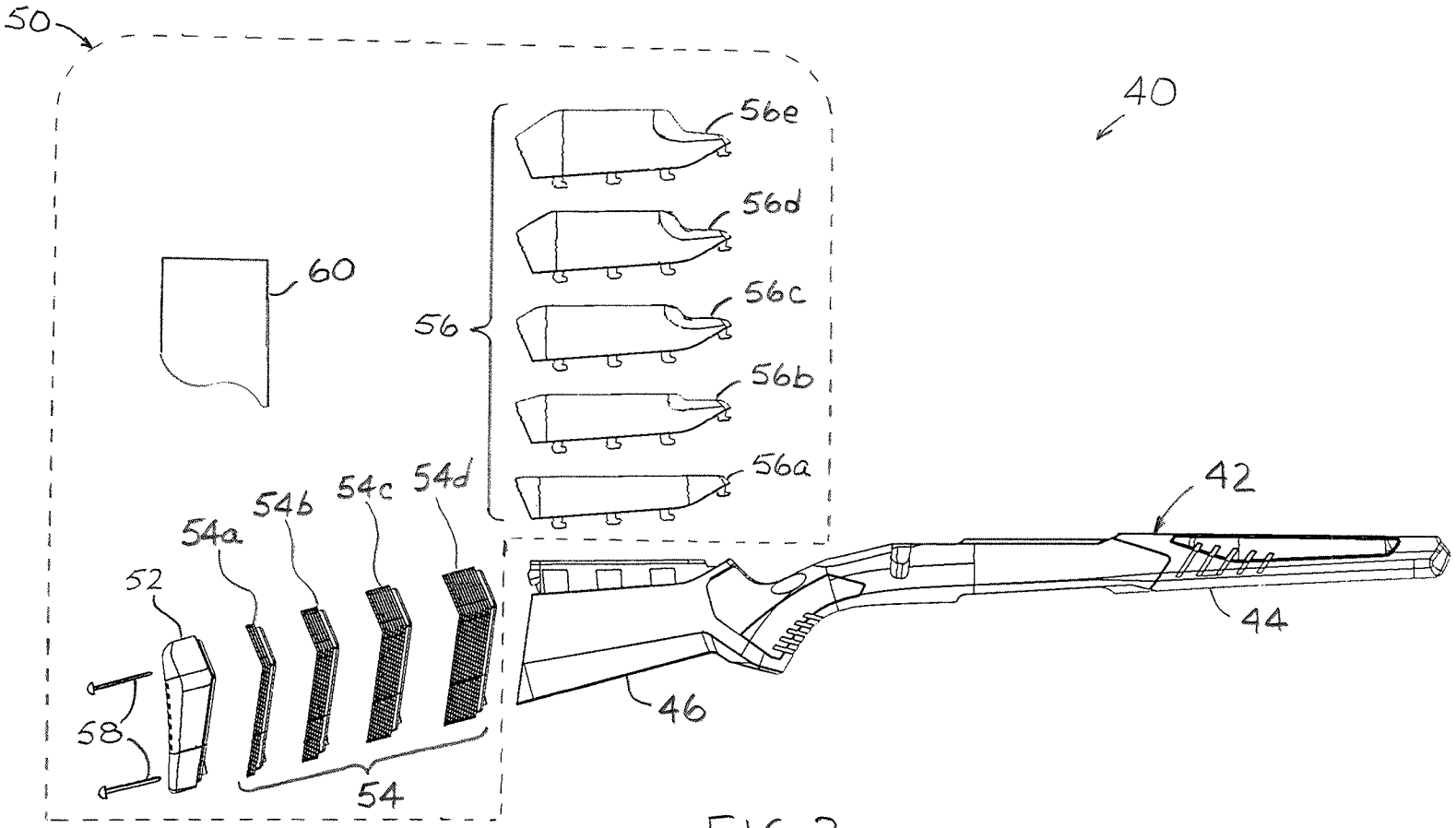
FIG. 2 is a side elevational view of a modular stock system for adjusting comb height and length of pull of a long gun according to an embodiment of the disclosure.
Figure 3:
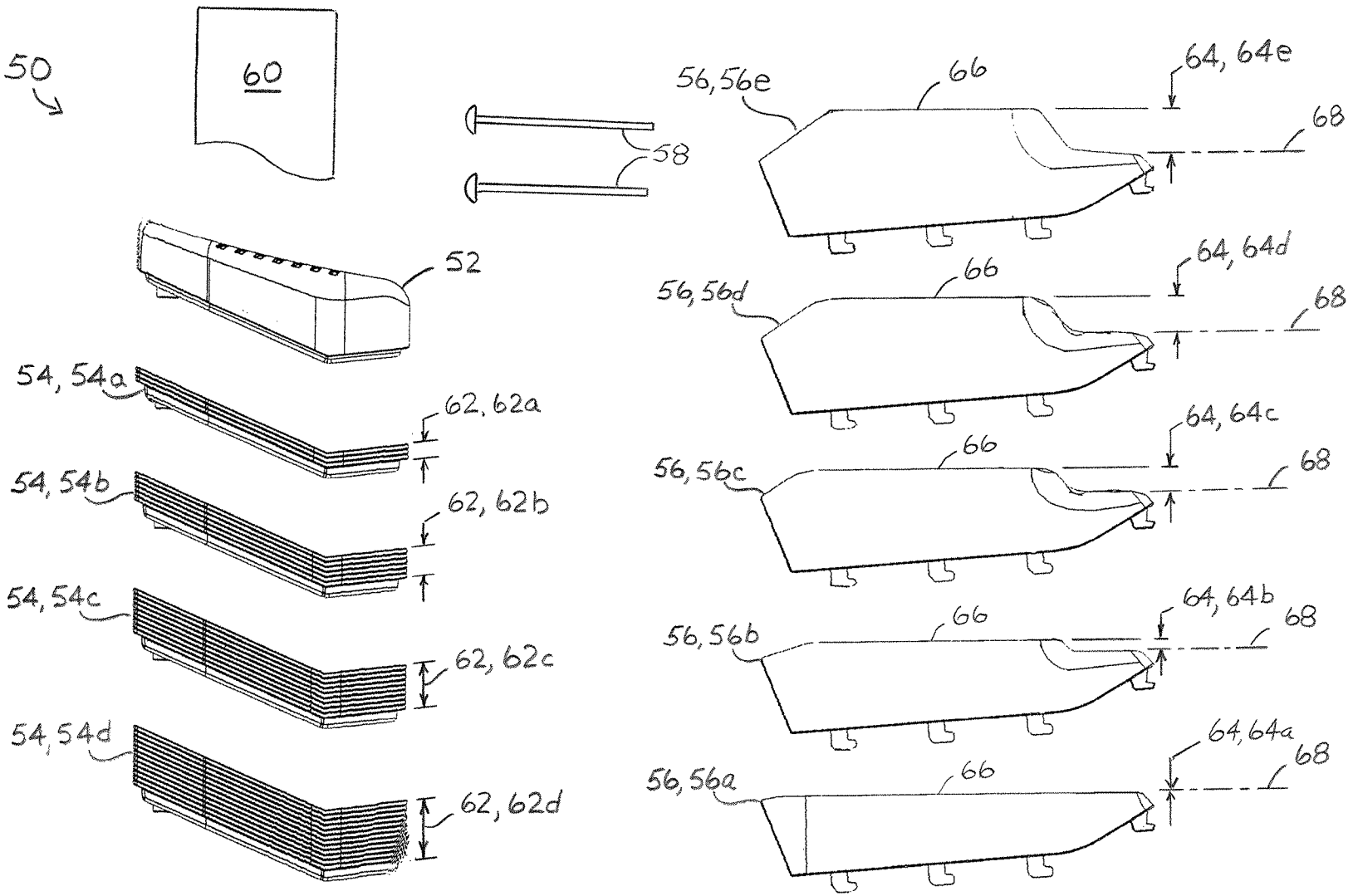
FIG. 3 is a kit of the modular stock system of FIG. 2 according to an embodiment of the disclosure.

Referring to FIGS. 2 and 3, a system 40 for tailoring a length of pull and a comb height (and therefore the drop) of a stock assembly for a long gun is depicted according to an embodiment of the disclosure. The system includes a stock 42 including a fore end 44 and a buttstock portion 46, and a kit 50 including a butt pad 52, a plurality of butt pad spacers 54, a plurality of comb portions 56, and at least one fastener 58. The kit 40 may also include a set of assembly instructions 60 on a tangible, non-transitory medium. The butt pad spacers 54 are each configured for coupling with the butt pad 52, and each define a respective spacing dimension 62 for spacing between the butt pad 52 and the buttstock portion 46. The comb portions 56 are each configured for direct connection with any one of the butt pad spacers 54 each of the plurality of comb portions 56 defining a respective comb height 64 that differs from the others of the plurality of comb portions 56. Each fastener 58 is configured to pass through the butt pad 52 and any one of the plurality of butt pad spacers 54 to threadably engage the buttstock 46. Each of the butt pad spacers 54 and each of the comb portions 56 are configured for coupling with the buttstock portion 46. In some embodiments, the butt pad 52, each of the butt pad spacers 54, and each of the comb portions 56 are configured for securing to the buttstock portion 46 with the at least one fastener 58.

Materials of construction for the buttstock portion 46, the comb portions 56, and the butt pad spacers 54 include, but are not limited to glass filled polypropylene, glass filled nylon, and carbon fiber mixed with fiberglass. A non-limiting range of the percentage of glass used in the glass-filled materials is 10% to 33% (long or short filled fibers). The mating components of the butt pad 52 (i.e., the portion of the butt pad 52 that interfaces with the butt pad spacers 54 or the buttstock 46 and comb portion 56) may be made of these materials as well, with a soft overmolded material, such as a thermoplastic elastomer (TPE).

Herein, the butt pad spacers 54 are referred to collectively and generically by reference character 54, and individually by the reference character 54 followed by a letter suffix (e.g., butt pad spacer 54*a*). Likewise, the comb portions 56, spacing dimensions 62, and comb heights 64 are referred to collectively and generically by reference characters 56, 62, and 64, respectively, and individually by the respective reference character followed by a letter suffix (e.g., comb portion 56*a*, spacing dimension 62*a*, and comb height 64*a*). Those of skill in the art recognize that the reference against which the comb height 64 is measured is arbitrary, and that the utility of the comb height metric for adjustment purposes is in the height difference between respective comb portions 56. Accordingly, the comb height 64 is depicted herein as a height of an upper edge 66 of the comb portion 56 relative to a reference line 68 that represents an unelevated comb portion 56. An unelevated or reference comb portion 56 is represented by comb portion 56*a*, so that the reference line 68 corresponds to the upper edge 66 of the comb portion 56*a* when installed on the buttstock portion 46, providing a comb height 64*a* of zero (i.e., the reference comb height).

Functionally, the plurality of butt pad spacers 54 and the plurality of comb portions 56 enable tailoring of both the comb height 64 and a length of pull of a long gun. In some embodiments, the kit 50 includes four butt pad spacers 54, each defining a unique spacing dimension 62 that differs from the spacing dimension 62 of the other butt pad spacers 54. In some embodiments, the butt pad 52 can be mounted directly to the buttstock portion 46 without a butt pad spacer 54. Accordingly, at least five unique lengths of pull are provided by the kit 50 as depicted. More or less butt pad spacers 54 of unique spacing dimension 62 may be provided in the kit 50 to enable configuration of more or less unique lengths of pull. In one non-limiting example, the comb heights 26 of the plurality of comb portions 56 vary by ⅛ inch increments. That is: comb portion 56*a* has a comb height 62*a* of zero (reference height); comb portion 56*b* has a comb height 62*b* of ⅛ inch; comb portion 56*c* has a comb height 62*c* of ¼ inch; comb portion 56*d* has a comb height 62*d* of ⅜ inch; and comb portion 56*e* has a comb height 62*e* of ½ inch;

In some embodiments, the butt pad spacers 54 may be configured to mate with each other, so that more than one butt pad spacer 54 may be stacked together in a stock configuration. The butt pad spacers 54 may be sized so that at least some combinations of butt pad spacers 54 provide an accumulation of spacing dimensions 62 that differs from any spacing dimension 62 provided by a single butt pad spacer 54. In this way, the number of unique spacing dimensions that can be created by the kit 50 may be greater than the number of butt pad spacers.

In the depicted embodiment, the kit 50 includes five comb portions 56, each defining a unique comb height 64, and thus providing five unique comb heights 64. Accordingly, the five comb portions 56 of unique comb heights 64 and the use of one or none of the four butt pad spacers 54 of unique spacing dimensions 62 provides at least 25 unique combinations of comb height 64 and length of pull.

In one non-limiting example, the spacing dimensions 62 of the plurality of butt pad spacers vary by quarter-inch increments (i.e., spacing dimension 62*a* at 0.25 inches, spacing dimension 62*b* at 0.25 inches, spacing dimension 62*c* at 0.75 inches, and spacing dimension 62*d* at 1.0 inches). Even more combinations may be realized by combining butt pad spacers 54 for additional unique spacing dimensions. That is, for the example spacing dimensions above, the spacing dimensions 62*b* and 62*c* may be combined by stacking butt pad spacers 54*b* and 54*c* for an overall spacing dimension of 1.25 inches.

Figure 4:
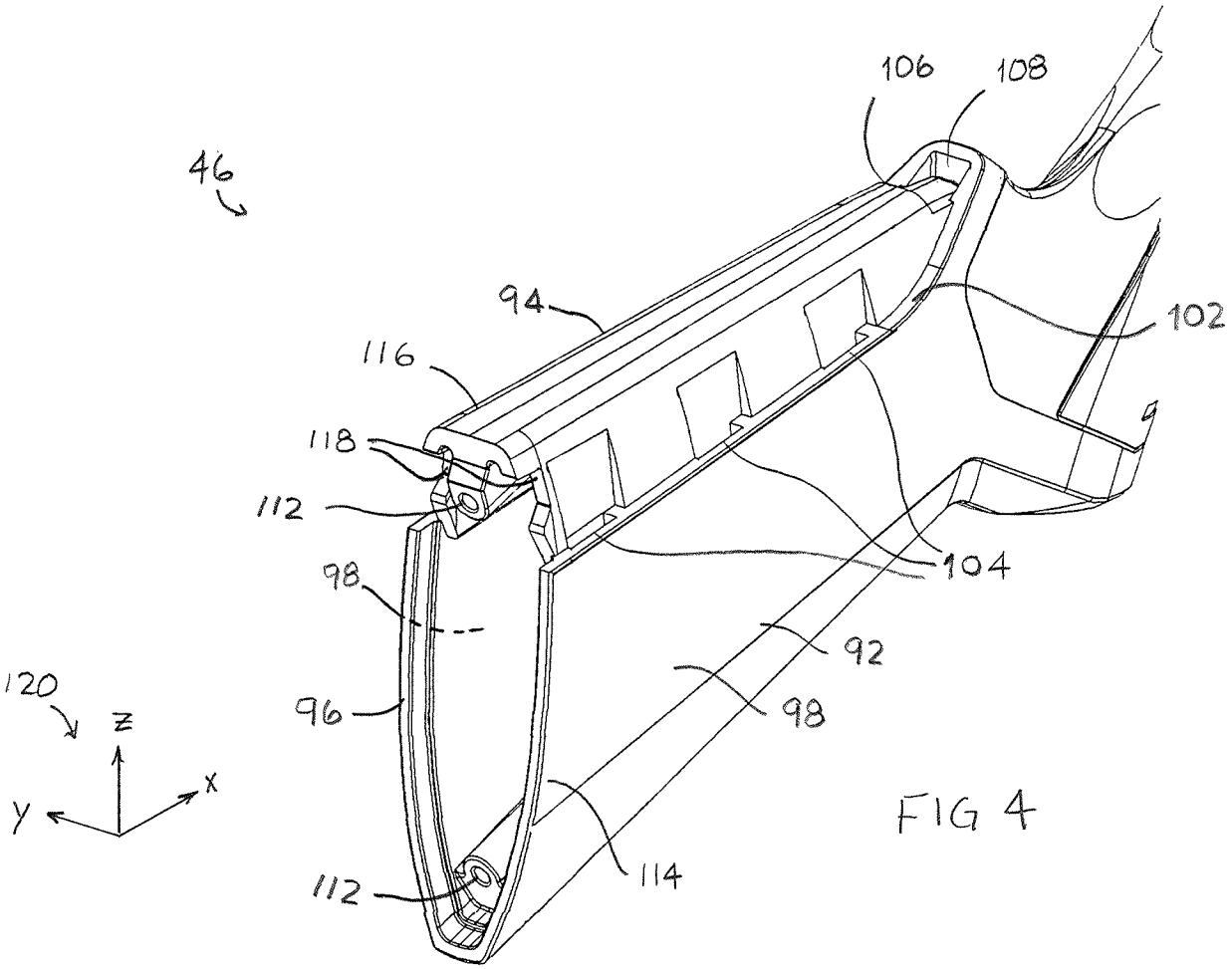
FIG. 4 is an upper rear perspective view of a buttstock of the modular stock system of FIG. 1 according to an embodiment of the disclosure.
Figure 7:
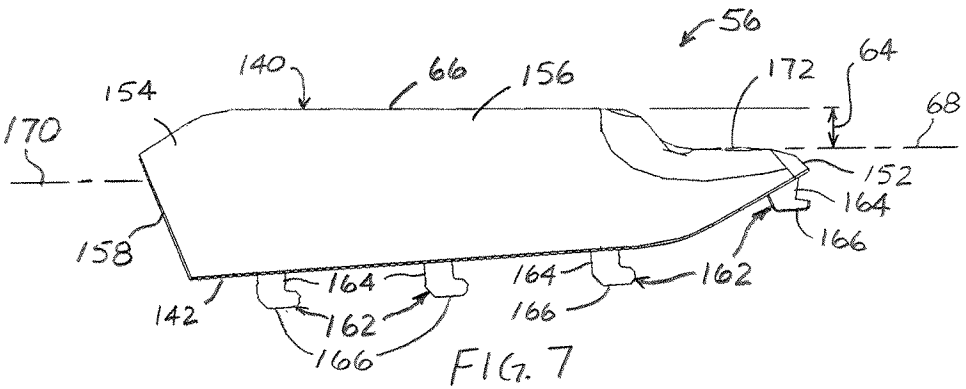
FIG. 7 is a side elevational view of the comb portion of FIG. 5 according to an embodiment of the disclosure.
Figure 8:
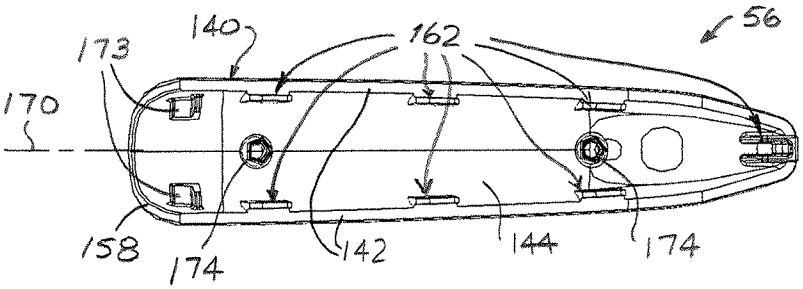
FIG. 8 is a bottom plan view of the comb portion of FIG. 5 according to an embodiment of the disclosure.
Figure 9:
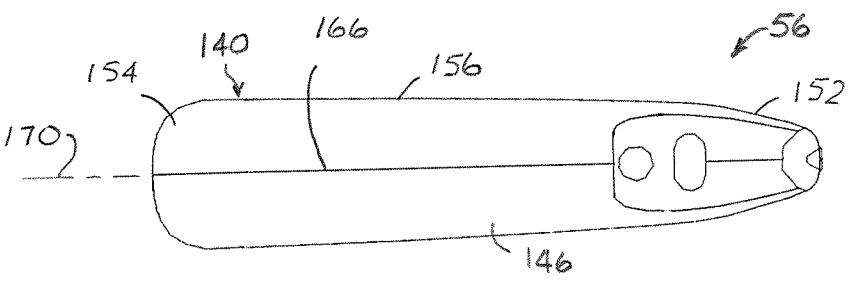
FIG. 9 is a top plan view of the comb portion of FIG. 5 according to an embodiment of the disclosure.
Figure 5:
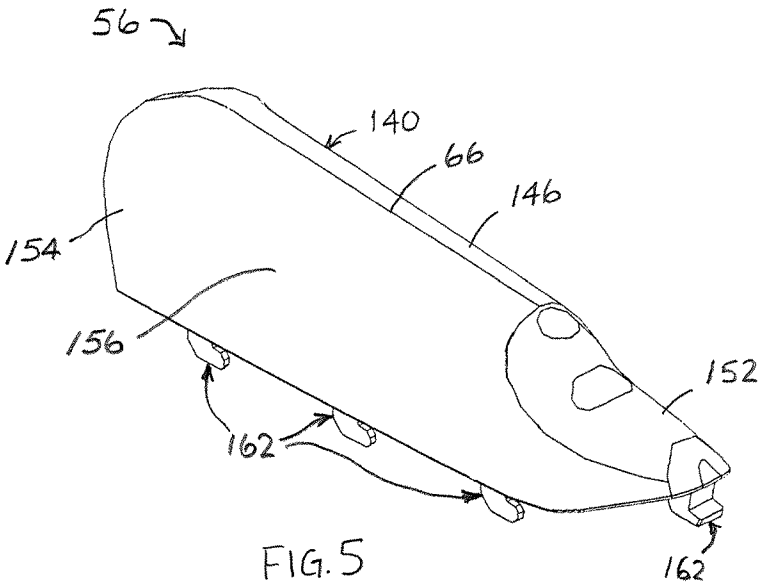
FIG. 5 is an upper front perspective view of a comb portion of the modular stock system of FIG. 2 according to an embodiment of the disclosure.
Figure 6:
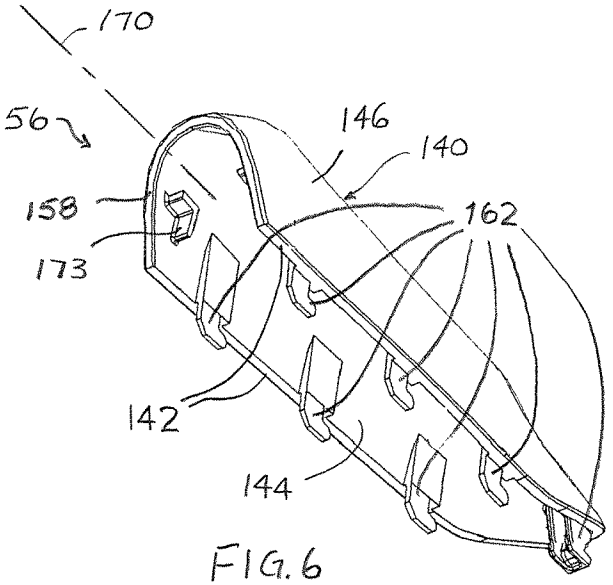
FIG. 6 is a lower rear perspective view of the comb portion of FIG. 5 according to an embodiment of the disclosure.

Referring to FIG. 4, the buttstock portion 46 is depicted according to an embodiment of the disclosure. The buttstock portion 46 may be unitary with the fore-end 44 of the stock 42 (depicted in FIG. 2). In the depicted embodiment, the buttstock 46 includes a lower portion 92 and an upper portion 94. The lower portion 92 includes a rearward registration surface 96 and opposed lateral faces 98. The upper portion 94 extends upward from the lower portion 92 and is configured to support the comb portion 56. In the depicted embodiment, the upper portion 94 is laterally inset from the opposed lateral faces 98 of the lower portion 92 to define a ridge 102 that extends axially along at least a portion of the buttstock portion 46.

Also in the depicted embodiment, the buttstock portion 46 includes a plurality of slots 104 defined along the ridge 102, the slots 104 being laterally inset from the opposed lateral faces 98. In some embodiments, the ridge 102 extends around a distal end 106 of the upper portion 94. The buttstock portion 46 may define a forward slot 108 between the distal end 106 of the upper portion 94 and the ridge 102. The buttstock portion 46 may define one or more tapping holes 112 proximate a rear end 114 of the buttstock portion 46, the tapping holes 112 being accessible from the rear. The tapping holes 112 may be pre-tapped with a threat, or may be an unthreaded hole configured to receive a self-tapping screw. In some embodiments, the tapping holes 112 include threaded inserts. In some embodiments, a rear portion 116 of the upper portion 94 defines notches 118 that are open to the rear.

Herein, reference to "forward", "distal", and the like is associated with a positive direction along the x-axis of a Cartesian coordinate 120. "Rear", "rearward", "proximal" and the like are associated with a negative direction along the x-axis of the Cartesian coordinate 120. "Upper", "top", and the like are associated with a positive direction along the z-axis of the Cartesian coordinate 120. "Lower", "bottom", and the like are associated with a negative direction along the z-axis of the Cartesian coordinate 120. Throughout this disclosure, references to "upper", "lower", "top", "bottom" "forward", "rearward", "lateral" and the like are relative to the orientation of the various components when the stock 42 is in a standard firing position. Such directional references are not intended to be limiting unless otherwise expressly stated.

Referring to FIGS. 5 through 11, a comb portion 56 is depicted according to an embodiment of the disclosure.

While comb portion 56*c* is depicted in FIGS. 5 through 11, the attributes discussed apply generally to all comb portions 56. The comb portion 56 includes a body 140 that extends from two lateral edge portions 142 and includes an inner surface 144 and an exterior surface 146. The body 140 includes a nose portion 152 and a rear transition portion 154 separated by a main portion 156, the rear transition portion 154 including a rearward registration surface 158. The comb portion 56 may include a plurality of hook portions 162 that extend from the inner surface 144 and below the two lateral edge portions 142. In the depicted embodiment, each of the hook portions 162 include a shank portion 164 and a bend portion 166, the bend portion 166 extending forward of the shank portion 164. The shank portion 164 may depend from the inner surface 144 of the body 140. In the depicted embodiment, the body 140 is arcuate about a longitudinal axis 170.

In the depicted embodiment, the nose portion 152 has an upper edge 172 that defines the reference line 68. In some embodiments, each of the comb portions 56 defines a rearward-facing opening 168 that is arcuate about the longitudinal axis 170, the opening 168 being configured to receive any one of the plurality of butt pad spacers 54. For comb portions 56 that have a comb height 64 greater than zero, the upper edge 66 of the main portion 156 is elevated relative to the upper edge 172 of the nose portion 152. The rear transition portion 154 of the comb portion 56 may include support features 173 that extend laterally inward from the inner surface 144 and are accessible via the opening 168. The comb portion 56 may include protrusions 174 that depend from the inner surface 144 of the main portion 156 that serve as a datum during manufacturing of the comb portion 56.

Figure 12:
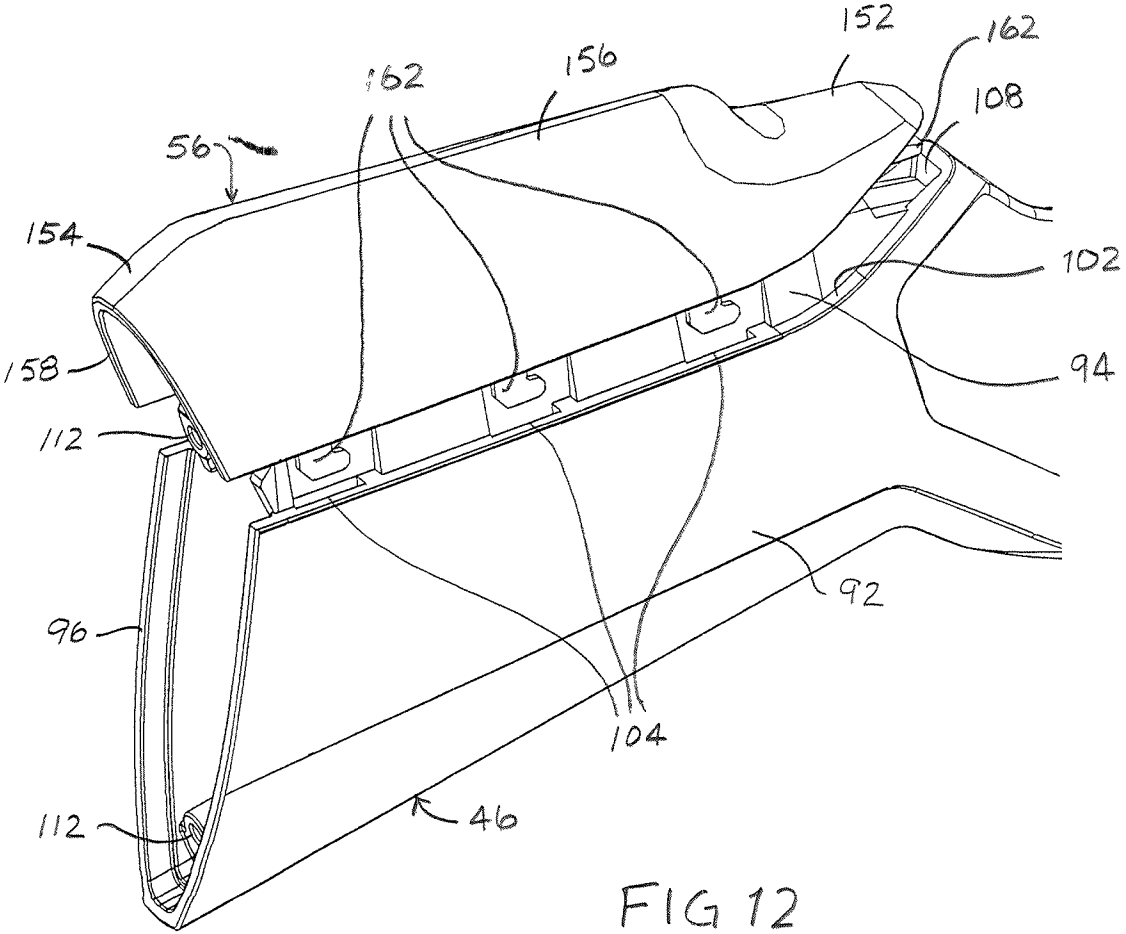
FIG. 12 is an upper rear perspective view of the comb portion of FIGS. 5 through 11 aligned over the buttstock of FIG. 4 during assembly according to an embodiment of the disclosure.
Figure 10:
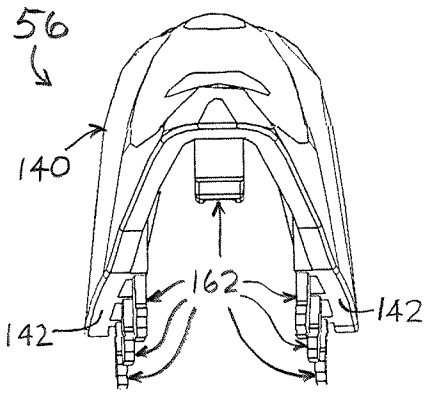
FIG. 10 is a front elevational view of the comb portion of FIG. 5 according to an embodiment of the disclosure.
Figure 11:
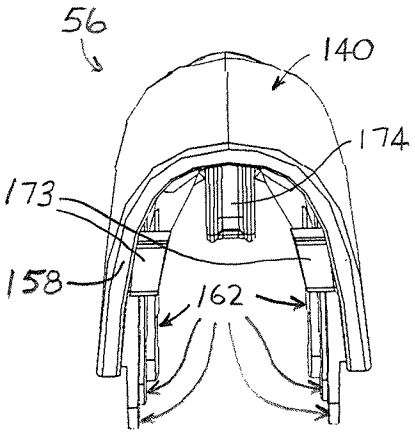
FIG. 11 is a rear elevational view of the comb portion of FIG. 5 according to an embodiment of the disclosure.
Figure 13:
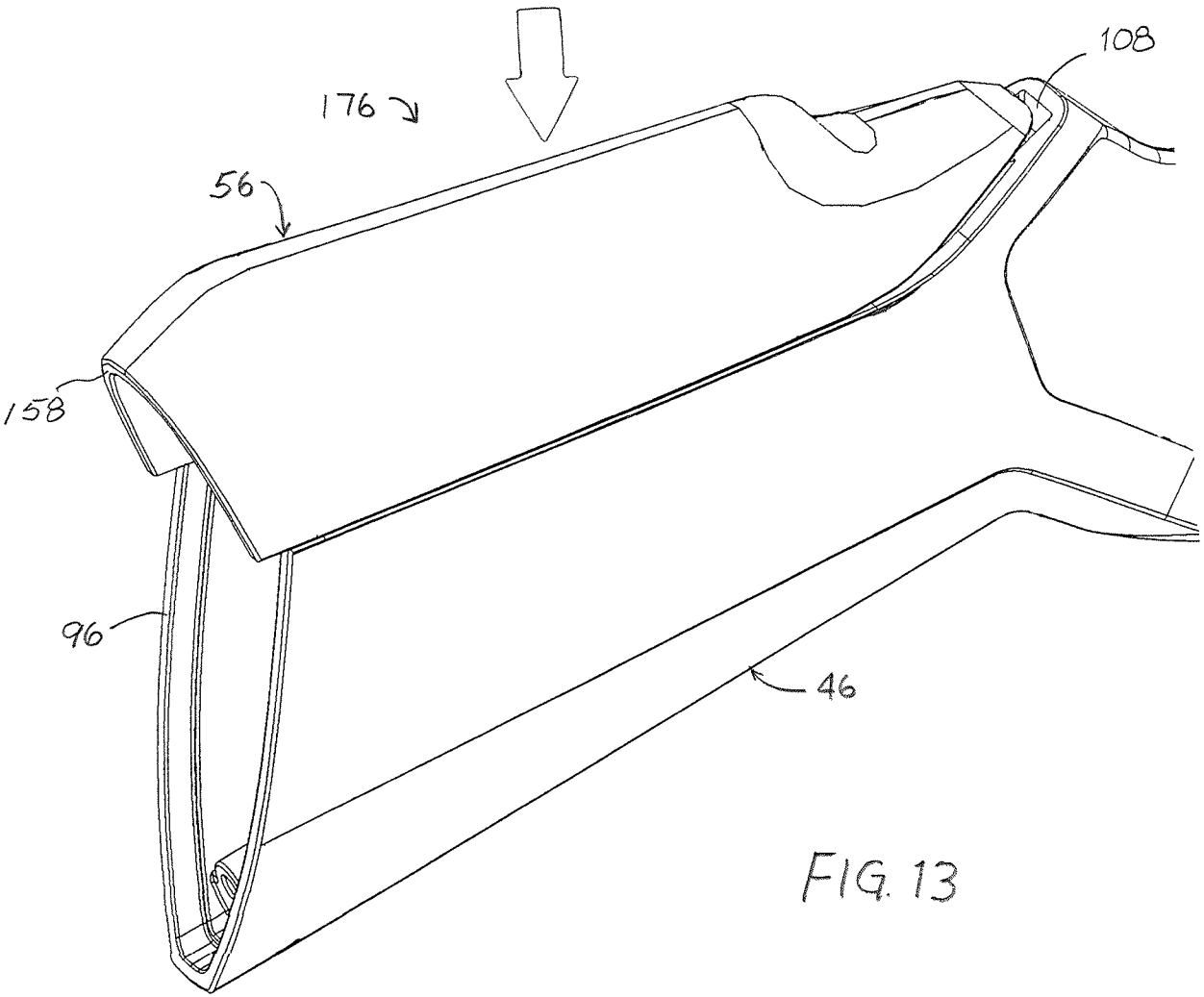
FIG. 13 is the upper rear perspective view of FIG. 12 with the comb portion inserted into the buttstock during assembly according to an embodiment of the disclosure.
Figure 14:
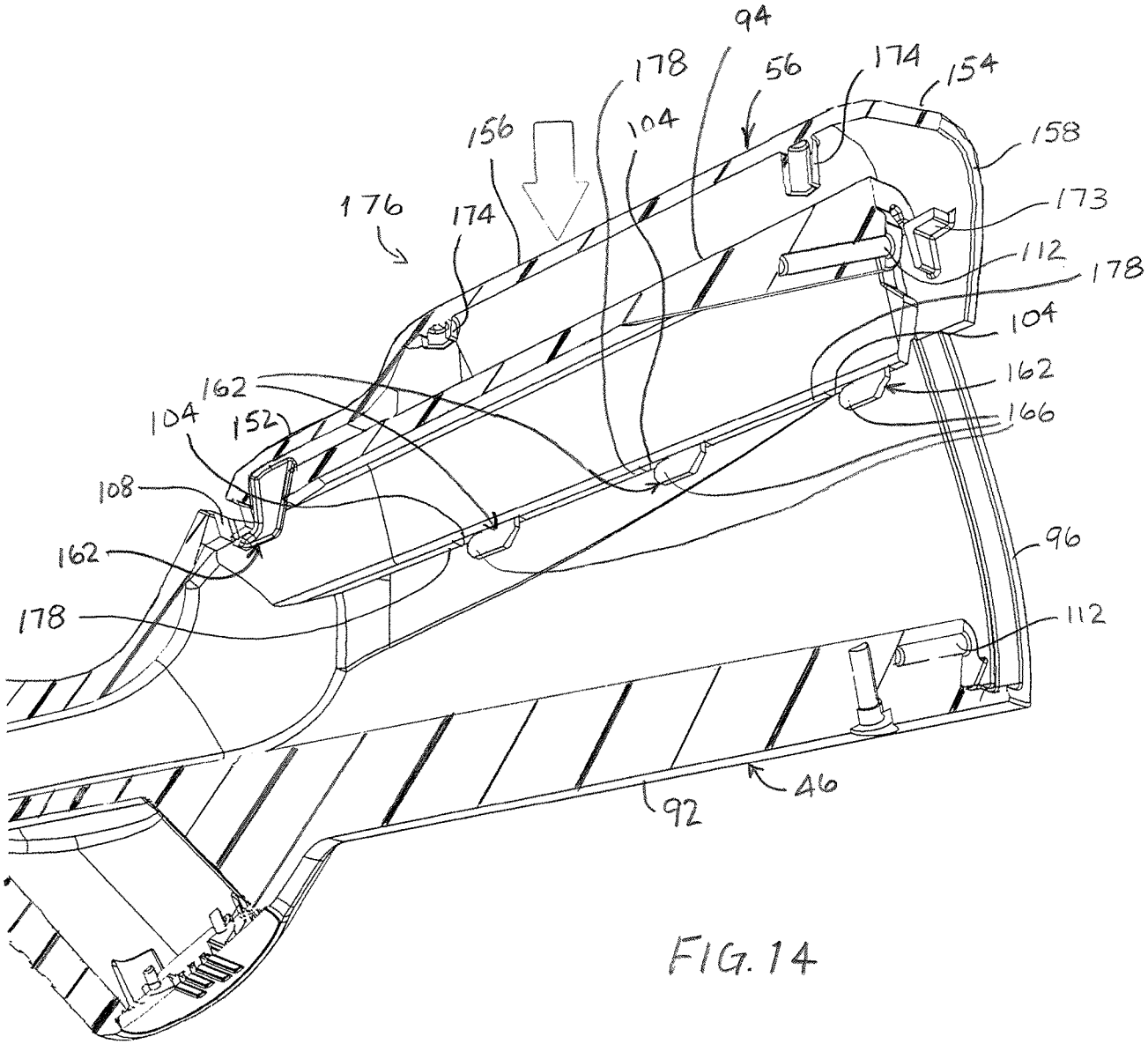
FIG. 14 is a lower perspective sectional view of the comb portion and buttstock of FIG. 13 according to an embodiment of the disclosure.
Figure 15:
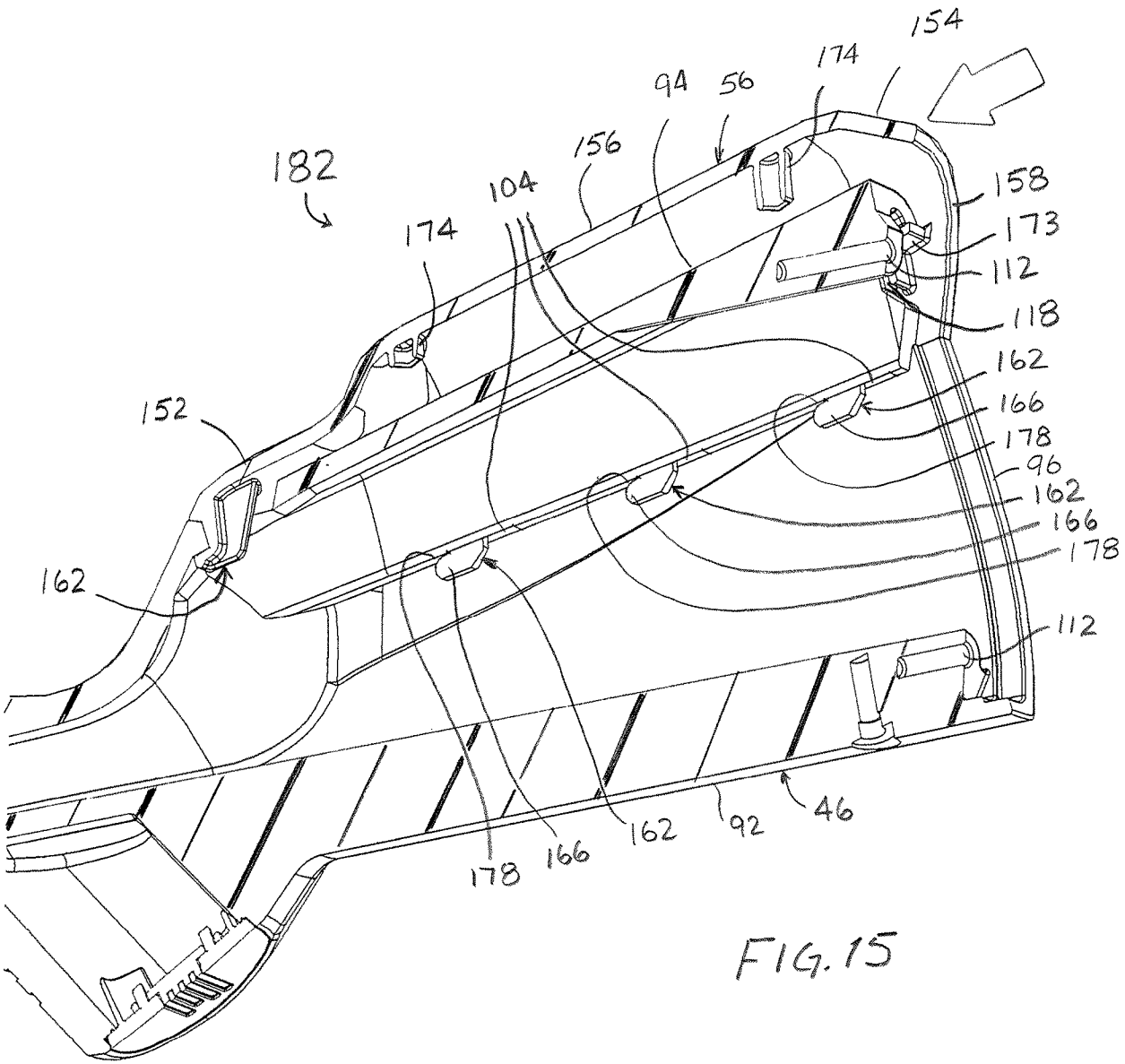
FIG. 15 is the lower perspective sectional view of FIG. 14 with the comb portion coupled to the buttstock according to an embodiment of the disclosure.

Referring to FIGS. 12 through 16, assembly of the comb portion 56 to the buttstock portion 46 is depicted according to an embodiment of the disclosure. Some or all of the steps for the assembly of the comb portion may be included in the assembly instructions 60. Each of the slots 104, 108 are configured to receive a corresponding one of the hook portions 162. The comb portion 56 is positioned over the buttstock portion 46 so that each of the hook portions 162 are aligned with the corresponding one of the hook portions 162 (FIG. 12). The comb portion 56 is mounted onto the buttstock portion 46 so that the hook portions 162 are received by the slots 104, 108 (FIG. 13) to assume a fully inserted position 176. In the fully inserted position 176, the bend portion 166 of each of the hook portions 162 extends below a lower perimeter 178 of the respective slot 104, 108 (FIG. 14). Also, the two lateral edge portions 142 of the comb portion 56 may register against the ridge 102 of the buttstock portion 46 in the fully inserted position 176.

Figure 16:
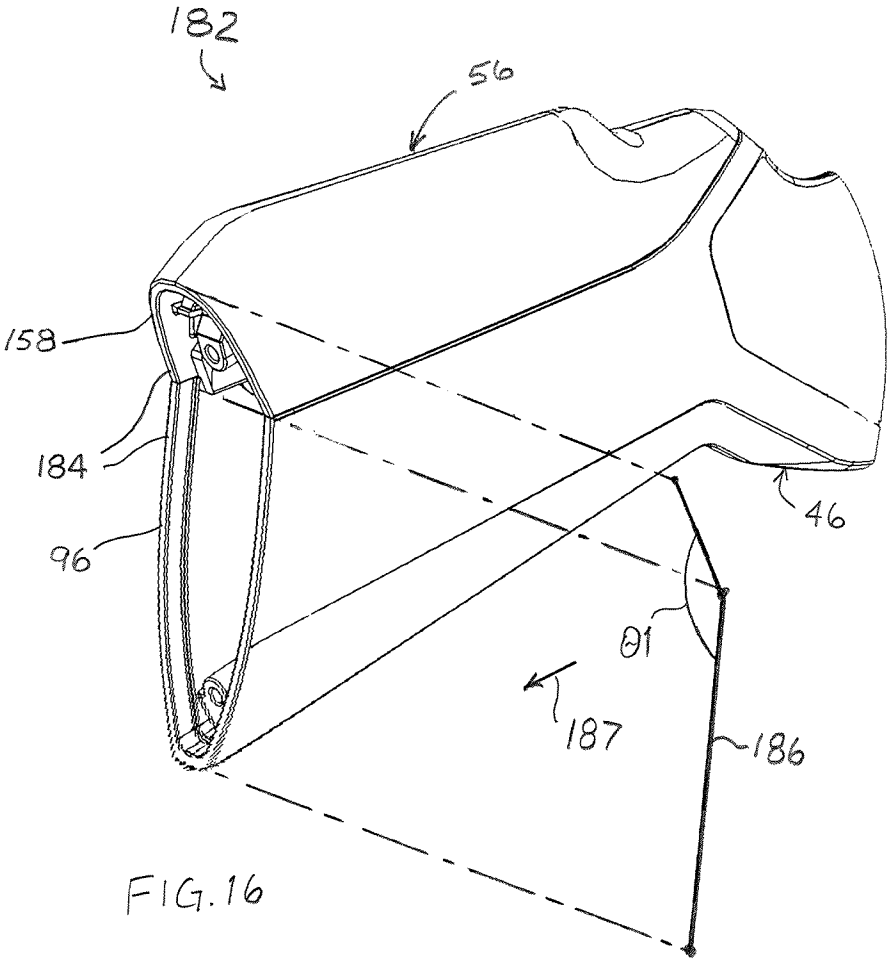
FIG. 16 is an upper rear perspective view of the comb portion coupled to the buttstock as in FIG. 15 according to an embodiment of the disclosure.
Figure 17:
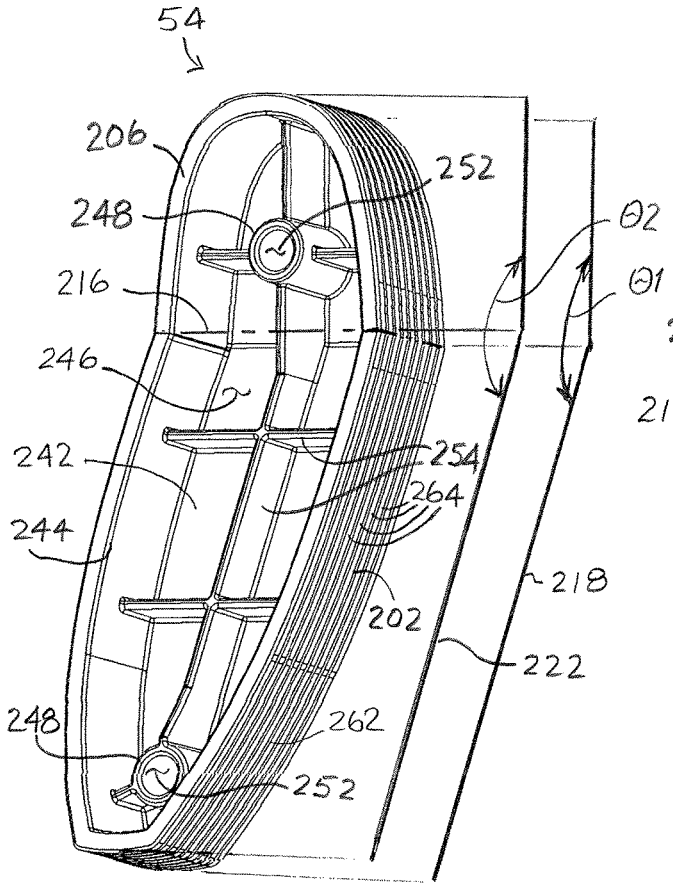
FIG. 17 is a rear perspective view of a butt pad spacer of the modular stock system of FIG. 2 according to an embodiment of the disclosure.

From the fully inserted position 176, the comb portion 56 is slid forward relative to the buttstock portion 46 (FIG. 15) to assume a coupled position 182 with the buttstock portion 46. The hook portions 162 are configured so that the bend portions 166 engage the lower perimeters 176 of the slots 104, 108 when the comb portion 56 is in the coupled position 182. The bend portions 166 may be deflected downward by the engagement with the lower perimeters 154, placing the hook portions 162 in tension. In some embodiments, the features 173 of the comb portion 56 engage the notches 118 of the buttstock portion 46 when the comb portion 56 is in the coupled position 182. The notches 118 may be positioned and configured to deflect the support features 173, and therefore the rear transition portion 154, downward. When the comb portion 56 is in the coupled position 182, the rearward registration surface 158 of the comb portion 56 and the rearward registration surface 96 of the buttstock portion 46 define a combined rearward registration surface 184. In some embodiments, the combined rearward registration surface 184 faces parallel to the x-z plane of the Cartesian coordinate 120 so as to define a lateral projection 186 of the combined rearward registration surface 184 defines a first obtuse angle θ1, the first obtuse angle θ1 being open in a rearward direction 187 (FIG. 16).

Referring to FIGS. 17 through 21, the butt pad spacer 54 is depicted according to an embodiment of the disclosure. In the depicted embodiment, the butt pad spacer 54 includes a continuous wall portion 202 including a forward registration surface 204 and a rearward registration surface 206 opposite the forward registration surface 204. The continuous wall portion 202 may include an upper portion 212 and a lower portion 214, the upper portion 212 being canted relative to the lower portion 214 about a laterally extending plane 216. For such embodiments, the spacing dimension 62 is defined as a distance between the forward registration surface 204 and the rearward registration surface 206 at and parallel to the laterally extending plane 216.

In some embodiments, the forward and rearward registration surfaces 204 and 206 face parallel to the x-z plane of the Cartesian coordinate 120 so as to define a lateral projection 218 of the forward registration surface 204 that defines the first obtuse angle θ1 at the laterally extending plane 216, and a lateral projection 222 of the rearward registration surface 206 that defines a second obtuse angle θ2 at the laterally extending plane 216. In the depicted embodiment, the lateral projection 218 of the forward registration surface 204 and the lateral projection 222 of the rearward registration surface 206 are orthogonal to the laterally extending plane 216. In some embodiments, the second obtuse angle θ2 is equal to the first obtuse angle θ1. In the depicted embodiment, the lateral projection 218 of the forward registration surface 204 and the lateral projection 222 of the rearward registration surface 206 extends linearly from the laterally extending plane 216. Non-linear lateral projections are also contemplated. That is, the registration surfaces 204, 206 as viewed from the lateral projection may define curves or undulations extending from the obtuse angles θ1, θ2 defined at the laterally extending plane 216.

In some embodiments, the butt pad spacer 54 includes a forward flange portion 224 that extends forward of the forward registration surface 204. A forward edge 226 of the forward flange portion 224 may define an obtuse angle at the laterally extending plane 216 that is equal to the first obtuse angle θ1. In other embodiments, rather than an extending flange, the registration surface 204 may be recessed relative to a front face (not depicted) of the butt pad spacer 54. In still other embodiments, the forward registration surface 204 is forward-most (not depicted), defining the distal extremity of the butt pad spacer 54 and further defining a cavity (not depicted) which receives structure (not depicted) on the proximal end of the buttstock portion 46.

In the depicted embodiment, the butt pad spacer 54 includes a front face portion 242 that is unitary with and surrounded by the continuous wall portion 202 or flush with the forward registration surface 204. The front face portion 242 may define an obtuse angle at the laterally extending plane 216 that is equal to the first obtuse angle θ1. The rearward registration surface 206 may also define an opening 244 that faces rearward, with the front face portion 242 and the continuous wall portion 202 cooperating to define a rear cavity 246 accessible via the opening 244. The rear cavity 246 may be configured to receive the butt pad 52. In some embodiments, at least one boss 248 extends proximally from the front face portion 242 into the rear cavity 246, each boss 248 defining a through passage 252. A lattice gusset structure 254 may also extend distally from the front face portion 242 and radially inward from the continuous wall portion 202, bridging the continuous wall portion 202 and boss(es) 248. In some embodiments, an outer face 262 of the continuous wall portion 202 defines a plurality of tangentially extending ribs 264. Each of the plurality of tangentially extending ribs 264 may follow the contour of the forward registration surface 204, thereby defining an obtuse angle at the laterally extending plane 216 that is equal to the first obtuse angle θ1.

Figure 18:
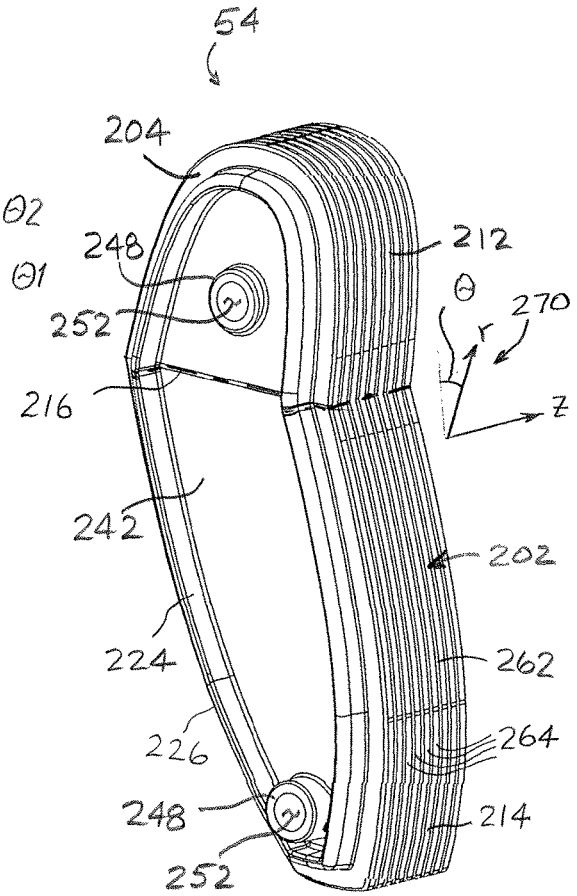
FIG. 18 is a front perspective view of the butt pad spacer of FIG. 17 according to an embodiment of the disclosure.
Figure 21:
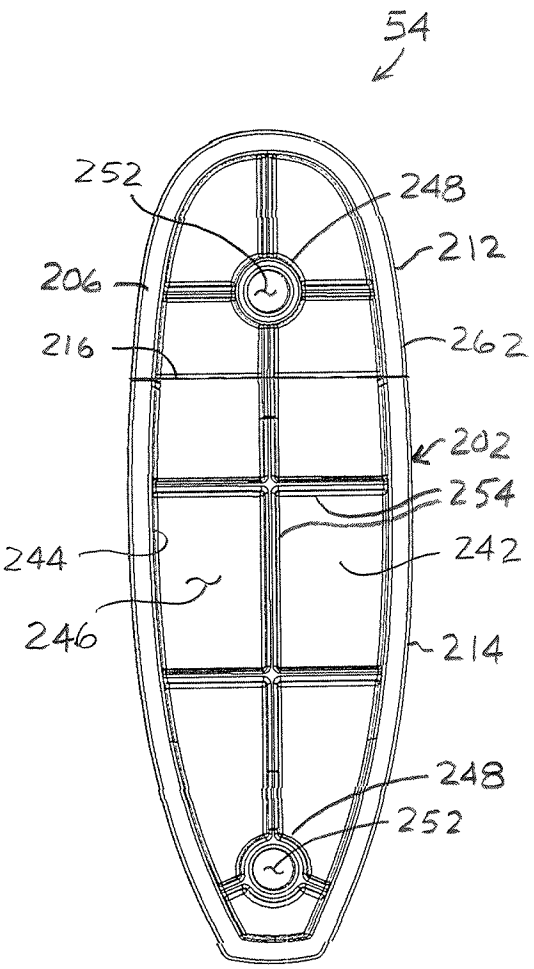
FIG. 21 is a rear elevational view of the butt pad spacer of FIG. 17 according to an embodiment of the disclosure.
Figure 20:
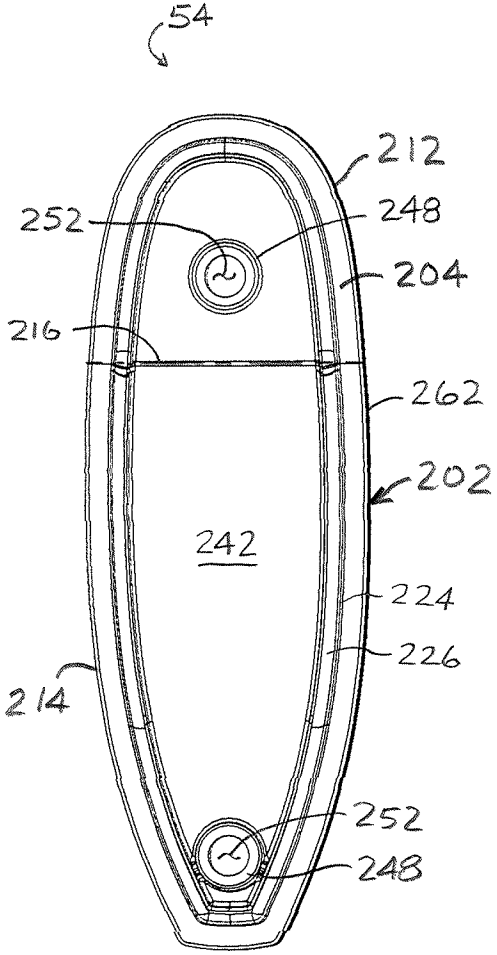
FIG. 20 is a front elevational view of the butt pad spacer of FIG. 17 according to an embodiment of the disclosure.
Figure 19:
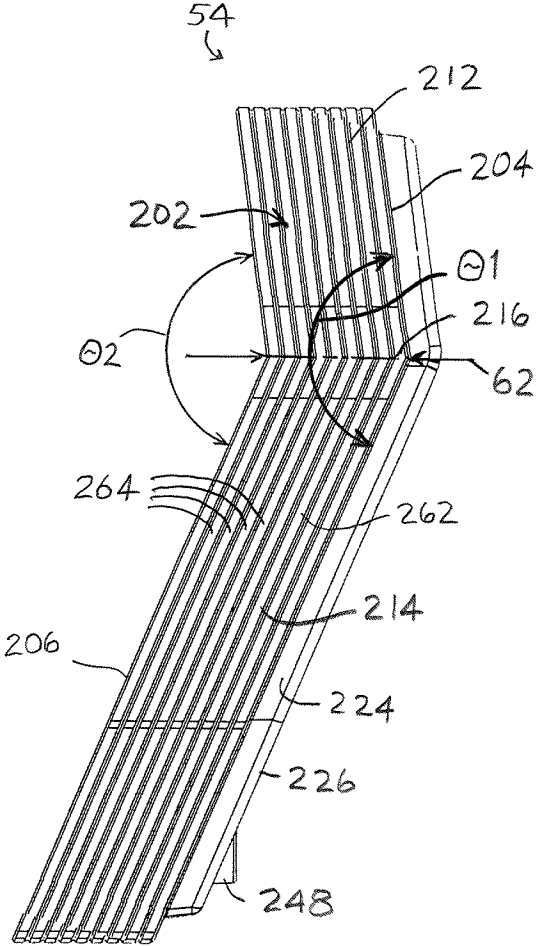
FIG. 19 is a side elevational view of the butt pad spacer of FIG. 17 according to an embodiment of the disclosure.

Herein, reference to "radial", "radially" and the like pertains to a direction associated with a radial coordinate r of a right-cylindrical coordinate 270 (FIG. 18). Reference to "tangential" pertains to a direction associated with the tangential coordinate θ of the right-cylindrical coordinate 270. The z-coordinate of the right-cylindrical coordinate 270 is oriented in the same direction as the x-axis of the Cartesian coordinate 120.

Figure 22:
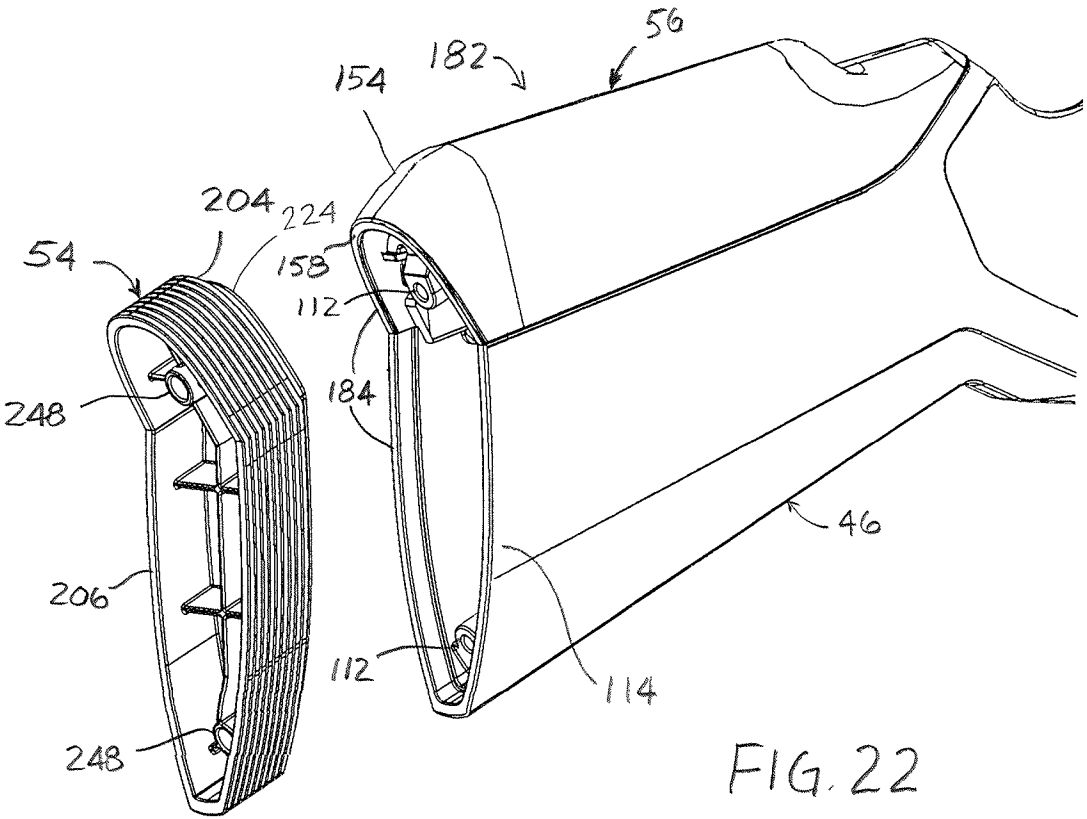
FIG. 22 is the upper rear perspective view of FIG. 16 with the butt pad spacer of FIGS. 17 through 21 aligned for coupling with the buttstock and comb portion according to an embodiment of the disclosure.
Figure 23:
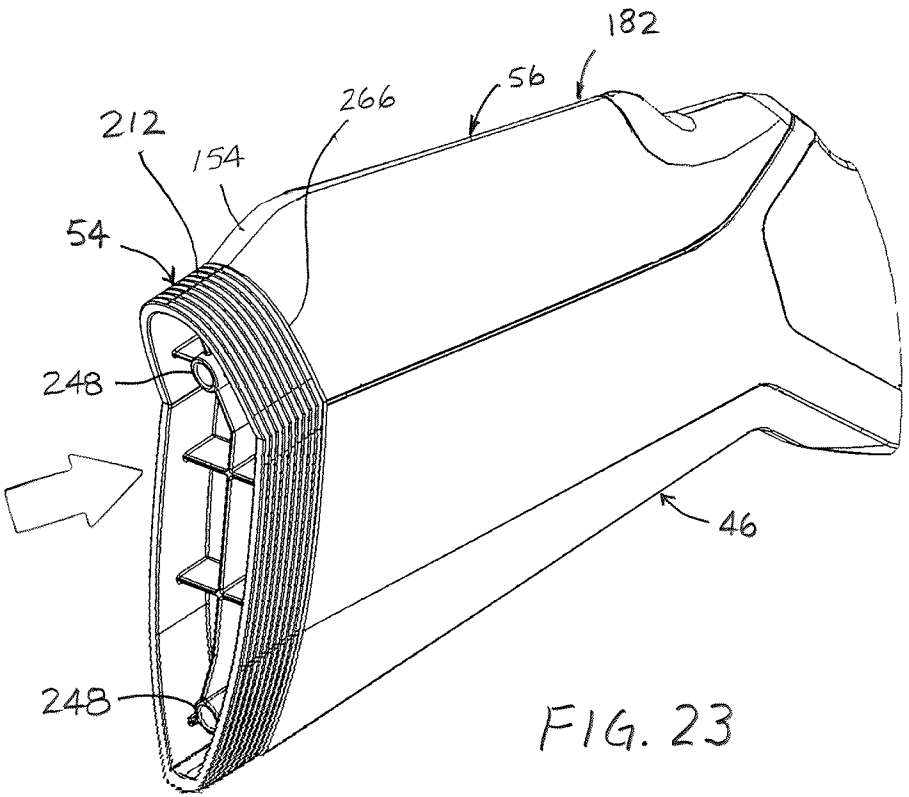
FIG. 23 is the upper rear perspective view of FIG. 22 with the butt pad spacer coupled to the buttstock portion and the comb portion.
Figure 24:
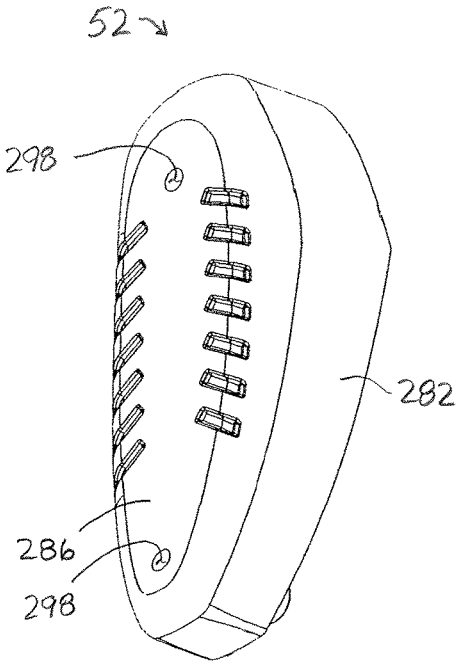
FIG. 24 is a lower rear perspective view of a butt pad of the modular stock system of FIG. 2 according to an embodiment of the disclosure.
Figure 25:
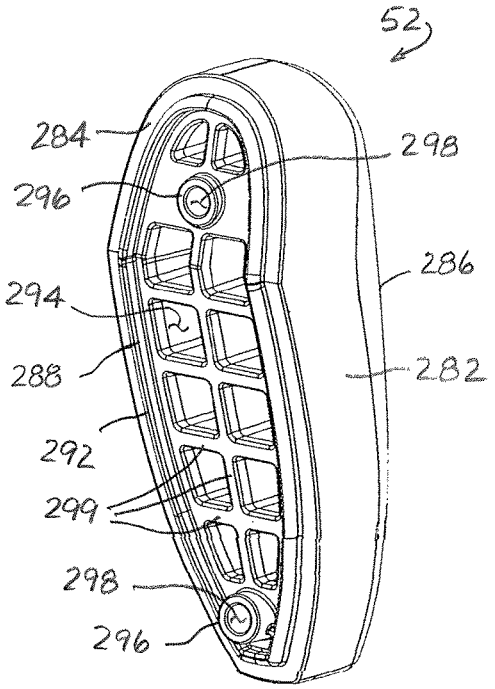
FIG. 25 is an upper front perspective view of the butt pad of FIG. 24 according to an embodiment of the disclosure.
Figure 26:
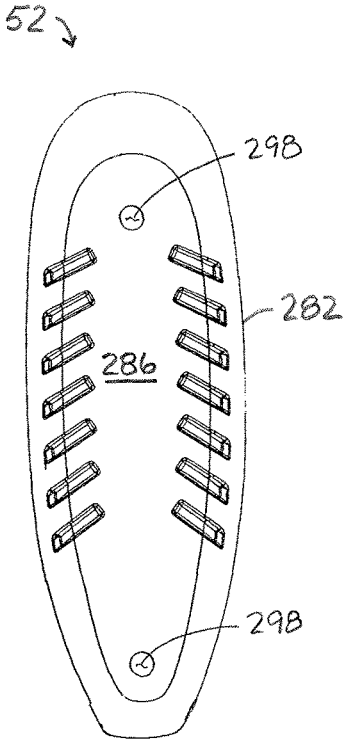
FIG. 26 is a rear elevational view of the butt pad of FIG. 24 according to an embodiment of the disclosure.
Figure 27:
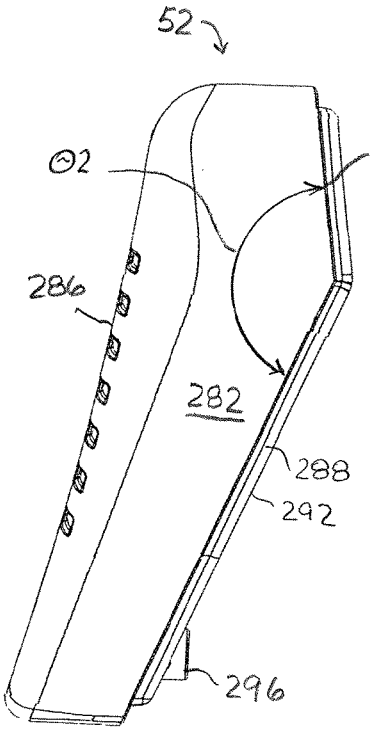
FIG. 27 is a side elevational view of the butt pad of FIG. 24 according to an embodiment of the disclosure.
Figure 28:
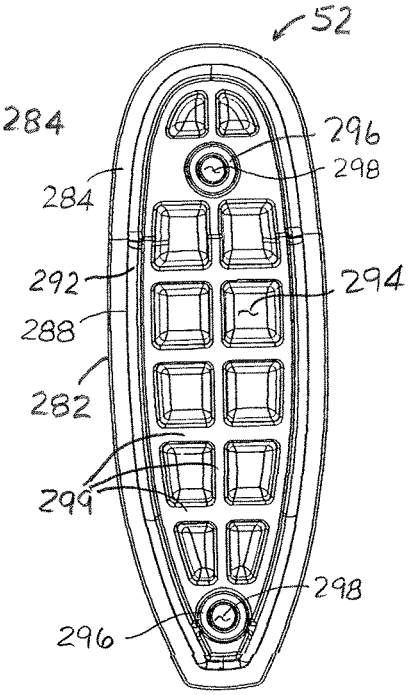
FIG. 28 is a front elevational view of the butt pad of FIG. 24 according to an embodiment of the disclosure.

Referring to FIGS. 22 and 23, assembly of the butt pad spacer 54 to the buttstock portion 46 is depicted according to an embodiment of the disclosure. Some or all of the steps for the assembly of the butt pad spacer 54 may be included in the assembly instructions 60. With the comb portion 56 in the coupled position 182, the butt pad spacer 54 is aligned with the rear end 114 of the buttstock portion 46 (FIG. 22). The butt pad spacer 54 is coupled to the buttstock portion 46, so that the forward registration surface 204 is registered against the combined rearward registration surface 184 of the buttstock portion 46 and comb portion 56 (FIG. 23). In some embodiments, the forward registration surface 204 and the combined rearward registration surface 184 are configured to provide a continuous line of contact. In the depicted embodiment, the rearward registration surface 158 of the rear transition portion 154 of the comb portion 56 is configured to form a miter joint 266 with the upper portion 212 of the butt pad spacer 54. With the butt pad spacer 54 coupled to the buttstock portion 46 and the comb portion 56, the through passage 252 of each boss 248 is aligned with a corresponding tapping hole 112 of the buttstock portion 46. In some embodiments, the flange portion 224 of the butt pad spacer 54 is inserted into the buttstock portion 46 and the comb portion 56, so that the buttstock portion 46 and the comb portion 56 cover the flange portion 224.

Referring to FIGS. 24 through 28, the butt pad 52 is depicted according to an embodiment of the disclosure. The butt pad 52 includes a continuous wall portion 282 including a registration surface 284 and a butt end portion 286 that extends rearward of the continuous wall portion 282. In some embodiments, the registration surface 284 is shaped for registration against either of the rearward registration surface 206 of the butt pad spacer or the combined rearward registration surface 184 of the buttstock portion and the comb portion. Seating of the registration surface 184 against the rearward registration surfaces 184, 206 may provide a continuous line of contact.

In some embodiments, the butt pad 52 includes a forward flange portion 288 that extends forward of the registration surface 284. A forward edge 292 of the forward flange portion 288 may define the second obtuse angle θ2 at a laterally extending plane 294, which may be equal to the first obtuse angle θ1. In other embodiments, rather than an extending flange, the registration surface 284 may be recessed relative to a front face (not depicted) of the butt pad 52. In still other embodiments, the registration surface 284 is forward-most (not depicted), defining the distal extremity of the butt pad 52 and further defining a cavity (not depicted) which receives structure (not depicted) on the proximal end of the butt pad spacers 54.

In some embodiments, the continuous wall portion 282 cooperates with the butt end portion 286 to define a forward cavity 294. At least one boss 296 may extend distally from the butt end portion 286 into the forward cavity 294, each boss 296 defining a through passage 298 that passes through the butt end portion 286. A lattice gusset structure 299 may also extend distally from the butt end portion 286 and radially inward from the continuous wall portion 282, bridging the continuous wall portion 282 and boss(es) 296.

Figure 29:
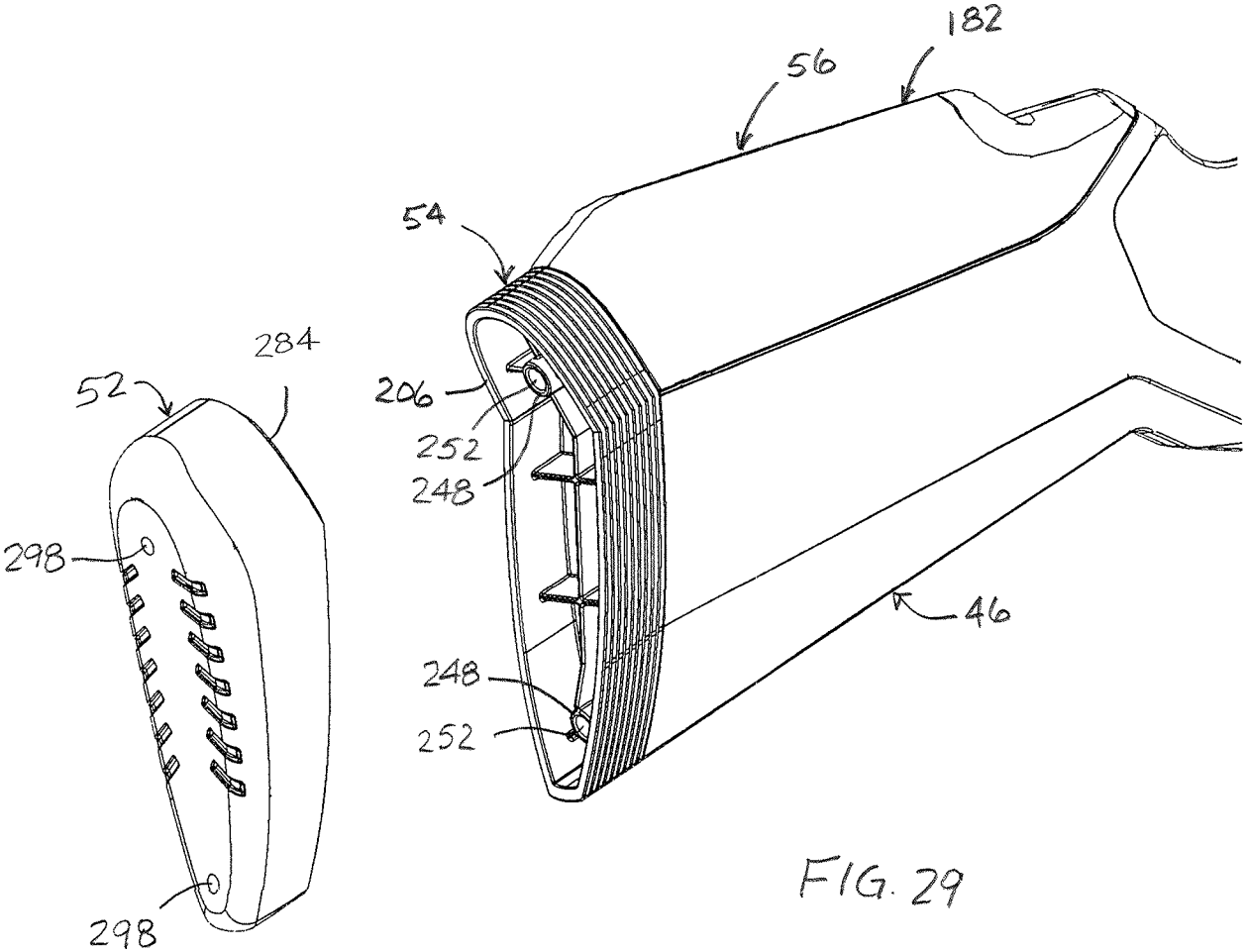
FIG. 29 is the upper rear perspective view of FIG. 23 with a butt pad aligned for coupling with the butt pad spacer according to an embodiment of the disclosure.
Figure 30:
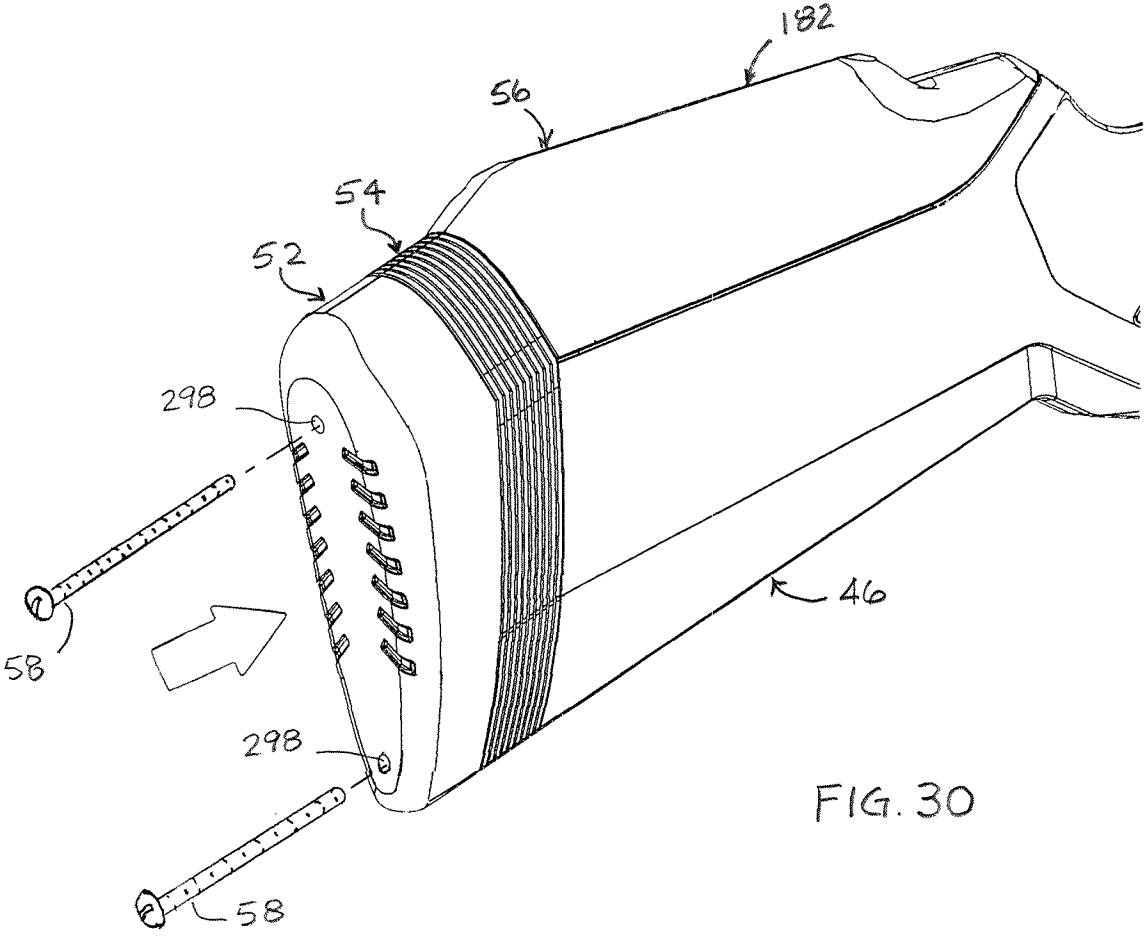
FIG. 30 is the upper rear perspective view of FIG. 29 with the butt pad coupled to the butt pad spacer and fasteners aligned for coupling to the modular stock assembly according to an embodiment of the disclosure.
Figure 31:
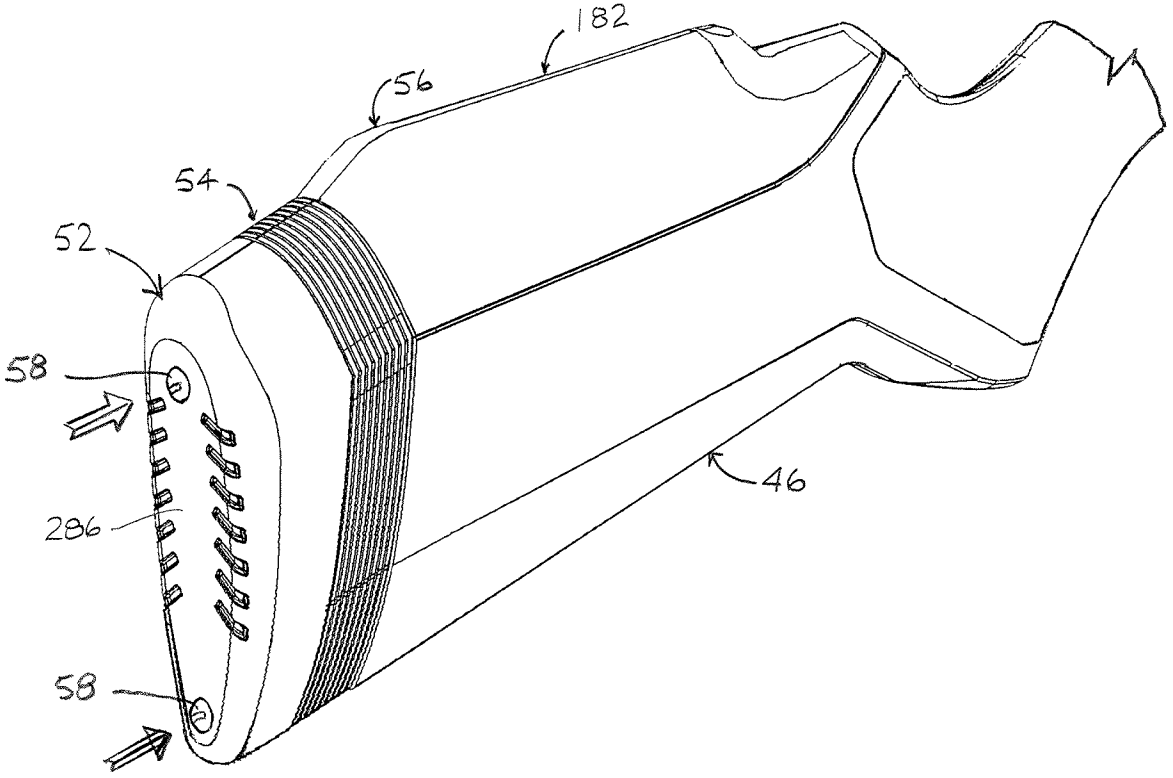
FIG. 31 is the upper rear perspective view of FIG. 30 with the fasteners securing the butt pad, butt pad spacer, and comb for a fully assembled modular stock assembly according to an embodiment of the disclosure.
Figure 34:
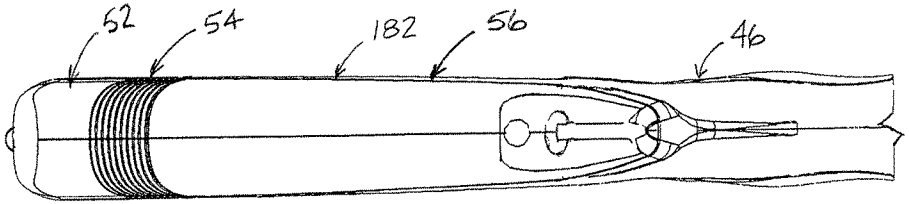
FIG. 34 is top plan view of the fully assembled modular stock assembly of FIG. 31 according to an embodiment of the disclosure.
Figure 35:
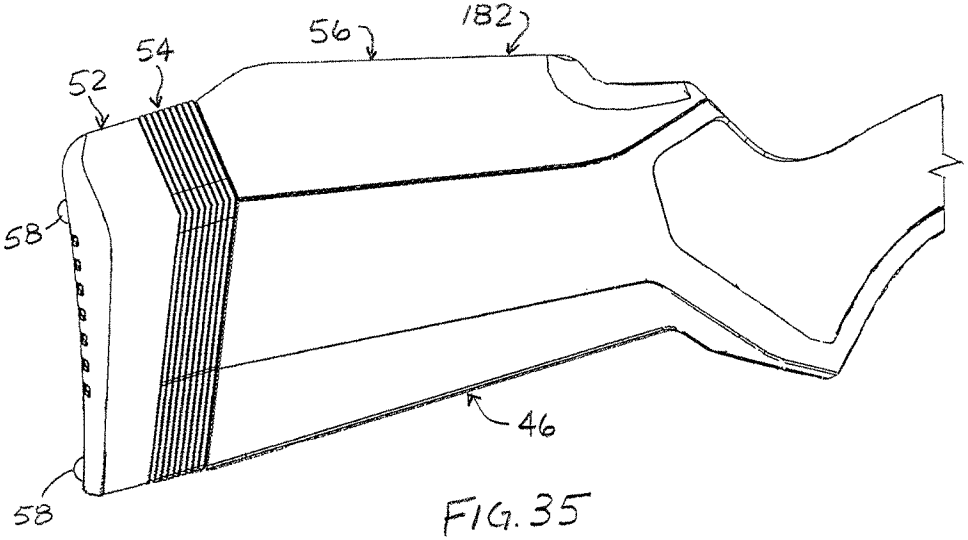
FIG. 35 is a side elevational view of the fully assembled modular stock assembly of FIG. 31 according to an embodiment of the disclosure.
Figure 36:
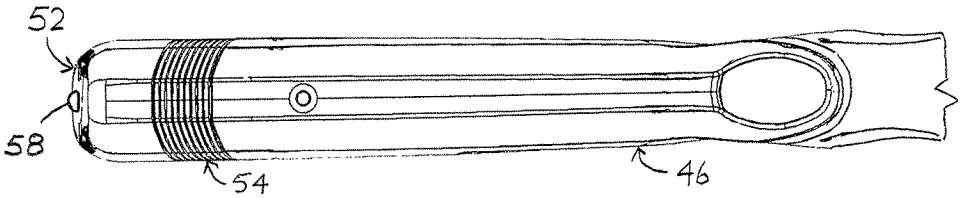
FIG. 36 is a bottom plan view of the fully assembled modular stock assembly of FIG. 31 according to an embodiment of the disclosure.
Figure 32:
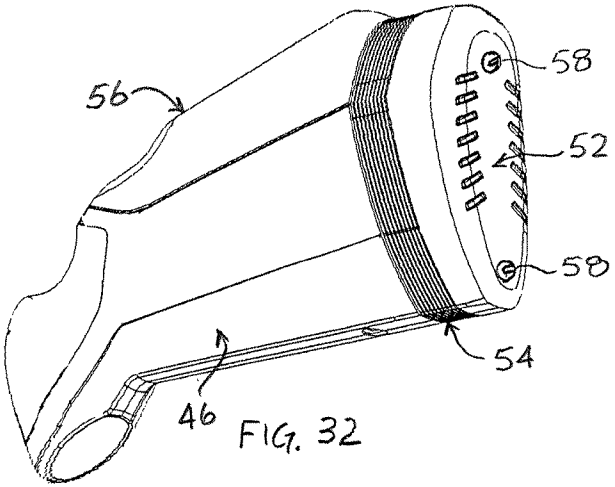
FIG. 32 is a lower rear perspective view of the fully assembled modular stock assembly of FIG. 31 according to an embodiment of the disclosure.
Figure 33:
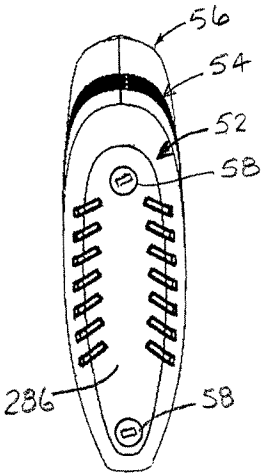
FIG. 33 is a rear elevational view of the fully assembled modular stock assembly of FIG. 31 according to an embodiment of the disclosure.

Referring to FIGS. 29 through 31, assembly of the butt pad 52 to the butt pad spacer 54 is depicted according to an embodiment of the disclosure. Some or all of the steps for the assembly of the butt pad 52 may be included in the assembly instructions 60. The butt pad 52 is aligned with the rearward registration surface 206 of the butt pad spacer 54 (FIG. 29). The butt pad 52 is coupled to the butt pad spacer 54 so that the registration surface 284 is registered against the rearward registration surface 206 of the butt pad spacer 54 (FIG. 30). In some embodiments, the registration surface 284 and the rearward registration surface 206 are configured to provide a continuous line of contact.

With the butt pad 52 coupled to the butt pad spacer 54, the through passage 298 of each boss 296 is aligned with the through passage 252 of the corresponding boss 248 of the butt pad spacer 54, and with the corresponding tapping hole 112 of the buttstock portion 46. In some embodiments, the flange portion 288 of the butt pad 52 is inserted into the butt pad spacer 54, so that the butt pad spacer 54 covers the flange portion 288.

Each fastener 58 is aligned with the through passage 298, accessible from the rear of the butt end portion 286 (FIG. 30), and inserted into the through passage 298. The fastener (s) 58 pass through the butt pad 52 and butt pad spacer 54 via the through passages 252 and 298 to engage the tapping hole(s) 112 of the buttstock portion 46. The fastener(s) 58 are threaded into the tapping hole(s) 112 to draw the butt pad 52, the butt pad spacer 54, the buttstock portion 46, and the comb portion 56 tightly together (FIGS. 31 through 36). In some embodiments, the fastener(s) 58 are self-tapping to form threads in the tapping hole(s) 112 during a first installation by the user.

Functionally, when the comb portion 56 is in the coupled position 182, the hook portions 162 prevent forward translation and upward separation of the comb portion 56 from the buttstock portion 46. The butt pad spacer 54 and butt pad 52, secured to the buttstock portion 46 with the fastener(s) 58, prevents the comb portion 56 from translating rearward and maintains the comb portion 56 in the coupled position 182. Accordingly, the fastener(s) 58, while not directly connected to or passing through a component of the comb portion 56, effectively secures the comb portion 56 to the buttstock portion 46. The tension present in the hook portions 162 holds the lateral edge portions 142 against the ridge 102 of the buttstock portion 46, thereby mitigating rattling between the comb portion 56 and the buttstock portion 46 and also preventing debris and moisture from entering the buttstock portion 46. The downward deflection of the support features 173 and rear transition portion 154 also acts to seat the lateral edge portion 142 against the ridge 102 of the buttstock portion 46 and to prevent the rear transition portion 154 from deflecting upward during the rigors of use.

The canted configuration of the upper portion 212 of the butt pad spacer 54 relative to the lower portion 214 provides a three-dimensional interface 300 that resists rotation of the butt pad spacer 54 that may otherwise cause the butt pad spacer 54 to rotate out of alignment with the buttstock portion 46 and comb portion 56. Consider an applied torsion that attempts to rotate the lower portion 214 of the butt pad spacer 54 parallel to the rearward registration surface 96 of the buttstock portion 46. In such a scenario, the forward registration surface 204 of the upper portion 212 of the butt pad spacer 54 will interact with the rearward registration surface 158 of the rear transition portion 154 of the comb portion 56 to prevent the rotation. That is, in this scenario, the upper portion 212 would not attempt to rotate parallel to the rearward registration surface 158 of the comb portion 56. Rather, the forward registration surface 204 of the upper portion 212 would effectively rotate into the rearward registration surface 158 of the comb portion 56. Accordingly, the rear transition portion 154 of the comb portion 56 would act as a stop that prevents the rotation. The rotation-resisting effect of the three-dimensional interface 300 between the forward registration surface 204 of the butt pad spacer 54 and the combined registration surface 184 of the buttstock portion 46 and the comb portion 56 applies to all torsional forces applied to the butt pad spacer 54. The second oblique angle θ2 of the rearward registration surface 206 of the butt pad spacer 54 and the registration surface 294 of the butt pad 52 also provides a three-dimensional interface, to the same effect.

The flange portion 224 aligns and maintains the orientation of the butt pad spacer 54 within the buttstock portion 46 and comb portion 56 during assembly. The flange portion 224 may also provide resistance to twisting of the butt pad spacer 54. The flange portion 224 provides an additional barrier against the entry of debris and moisture into the buttstock portion 46. Embodiments implementing the continuous line of contact between the forward registration surface 204 and the combined rearward registration surface 184 also provides a barrier against debris and moisture.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Unless indicated otherwise, references to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A long gun with a system for tailoring a comb height and a length of pull of the long gun, the long gun comprising a buttstock portion with an attachment end for receiving butt pad components and an upper portion for receiving comb portions, and a kit, including:

a plurality of pull adjusting components for adjusting the length of pull of the long gun, the pull adjusting components including a butt pad, the plurality of pull adjusting components attachable to the attachment end of the buttstock portion;

a plurality of comb portions, each of said comb portions configured for direct connection with the upper portion of the buttstock portion, each comb portion defining a respective comb height that differs from the others of said plurality of comb portions; and wherein each of said plurality of components for adjusting the length of pull are discrete from each of the plurality of comb portions.

2. The long gun with a system for tailoring a comb height and a length of pull of claim 1, wherein the plurality of pull adjusting components further includes a plurality of butt pad spacers, each configured for positioning intermediate said butt pad and the attachment end of the buttstock portion.

3. The long gun with a system for tailoring a comb height and a length of pull of claim 2, wherein each of said plurality of butt pad spacers defining a respective spacing dimension between said butt pad and said buttstock portion.

4. The long gun with a system for tailoring a comb height and a length of pull of claim 1, wherein each of said plurality of comb portions defines a rearward-facing opening configured to receive any one of said plurality of pull adjusting components.

5. The long gun with a system for tailoring a comb height and a length of pull of claim 1, wherein a forward registration surface of a respective pull adjusting component of said plurality of pull adjusting components defines a three-dimensional interface that contacts a registration surface of said comb portion and a registration surface of said buttstock portion.

6. The long gun with a system for tailoring a comb height and a length of pull of claim 5, wherein a rear registration surface of said comb portion is configured to register against and form a miter joint with said forward registration surface.

7. A modular buttstock for a firearm, comprising a buttstock portion, a plurality of interchangeable butt pad components coupleable to a rear end of said buttstock portion, and a plurality of interchangeable comb portions coupleable to an upper portion of said buttstock portion, said plurality of butt pad components discrete from the plurality of interchangeable comb portions.

8. The modular buttstock of claim 7, wherein said buttstock portion includes a plurality of slots defined along a ridge at said upper portion, said slots being laterally inset from opposed lateral faces of the buttstock portion.

9. The modular buttstock of claim 8, wherein each of the plurality of comb portions comprise an arcuate body extending from two lateral edge portions and having an inner surface and a plurality of hook portions extending from said inner surface and beyond said two lateral edge portions, each of said plurality of slots configured to receive a corresponding one of said plurality of hook portions.

10. The modular buttstock of claim 9, wherein each of said plurality of hook portions comprise a shank portion and a bend portion, said shank portion depending from said inner surface, said bend portion extending forward of said shank portion said bend portion of each of said plurality of hook portions extending below and engaging a perimeter of said corresponding one of said plurality of slots.

11. The module buttstock of claim 9, wherein said plurality of hook portions are configured to urge said two lateral edge portions toward said ridge at said upper portion.

12. The modular buttstock of claim 7, wherein each of said plurality of comb portions define respective rearward registration surfaces for engaging respective registration surfaces of the interchangeable butt pad components.

13. The modular buttstock of claim 12, wherein the respective rearward registration surfaces of each of said plurality of comb portion and a rearward registration surface of the buttstock portion define a continuous line of contact with the respective registration surface of the interchangeable butt pad components.

14. The modular buttstock of claim 12, wherein the plurality of interchangeable butt pad components comprise a plurality of butt pad spacers for insertion between a butt pad and the rear end of the buttstock portion.

15. The modular buttstock of claim 14, wherein said butt pad comprises an thermoplastic elastomer.

16. The modular buttstock of claim 14, wherein each of said plurality of butt pad spacers comprises a continuous wall portion including a forward registration surface, a rearward registration surface opposite said forward registration surface, and a forward flange portion that extends forward of said forward registration surface, said respective rearward registration surface of each said plurality of comb portions covering at least a portion of said flange portion.

17. The modular buttstock of claim 16, wherein said continuous wall portion includes an upper portion and a lower portion, said upper projection being canted relative to said lower portion about a laterally extending plane, wherein a lateral projection of said forward registration surface defines said first obtuse angle at said laterally extending plane and a lateral projection of said rearward registration surface defines a second obtuse angle at said laterally extending plane, said lateral projection of said forward registration surface and said lateral projection of said rearward registration surface being orthogonal to said laterally extending plane.

* * * * *